US007252575B2

(12) United States Patent
Kobayashi et al.

(10) Patent No.: US 7,252,575 B2
(45) Date of Patent: Aug. 7, 2007

(54) POLISHING STATE MONITORING APPARATUS AND POLISHING APPARATUS AND METHOD

(75) Inventors: Yoichi Kobayashi, Tokyo (JP); Shunsuke Nakai, Tokyo (JP); Hitoshi Tsuji, Tokyo (JP); Yasuo Tsukuda, Osaka (JP); Junki Ishimoto, Shiga (JP); Kazunari Shinya, Osaka (JP)

(73) Assignees: EBARA Corporation, Tokyo (JP); Shimadzu Corporation, Kyoto (JP)

( * ) Notice: Subject to any disclaimer, the term of this patent is extended or adjusted under 35 U.S.C. 154(b) by 123 days.

(21) Appl. No.: 10/526,933

(22) PCT Filed: Oct. 15, 2003

(86) PCT No.: PCT/JP03/13171

§ 371 (c)(1),
(2), (4) Date: Mar. 8, 2005

(87) PCT Pub. No.: WO2004/035265

PCT Pub. Date: Apr. 29, 2004

(65) Prior Publication Data

US 2006/0166606 A1 Jul. 27, 2006

(30) Foreign Application Priority Data

Oct. 17, 2002 (JP) ..... 2002-303628
Sep. 12, 2003 (JP) ..... 2003-321639

(51) Int. Cl.
*B24B 1/00* (2006.01)
*B24B 49/00* (2006.01)
*B24B 51/00* (2006.01)

(52) U.S. Cl. ..... 451/6; 451/8; 451/41

(58) Field of Classification Search ..... 451/5, 451/6, 8, 10, 11, 36, 58, 63, 287, 288, 290, 451/630; 356/72, 73
See application file for complete search history.

(56) References Cited

U.S. PATENT DOCUMENTS 5,672,091 A 9/1997 Takahashi et al.
6,106,662 A * 8/2000 Bibby et al. ..... 156/345.13
6,111,634 A * 8/2000 Pecen et al. ..... 356/72

(Continued)

FOREIGN PATENT DOCUMENTS

EP 1022093 A2 7/2000

*Primary Examiner*—Timothy V. Eley
(74) *Attorney, Agent, or Firm*—Wenderoth, Lind & Ponack, L.L.P.

(57) ABSTRACT

A polishing state monitoring apparatus measures characteristic values of a surface, being polished, of a workpiece to determine the timing of a polishing end point. The polishing state monitoring apparatus includes a light-emitting unit for applying light from a light source to a surface of a workpiece being polished, a light-receiving unit for receiving reflected light from the surface of the workpiece, a spectroscope unit for dividing the reflected light received by the light-receiving unit into a plurality of light rays having respective wavelengths, and light-receiving elements for accumulating the detected light rays as electrical information. The polishing state monitoring apparatus further includes a spectral data generator for reading the electrical information accumulated by the light-receiving elements and generating spectral data of the reflected light, and a processor for calculating a predetermined characteristic value on the surface of the workpiece based on the spectral data generated by the spectral data generator.

18 Claims, 10 Drawing Sheets

U.S. PATENT DOCUMENTS 6,159,073 A * 12/2000 Wiswesser et al. ..... 451/6
6,172,756 B1 * 1/2001 Chalmers et al. ..... 356/630
6,190,234 B1 2/2001 Swedek et al.
6,247,998 B1 6/2001 Wiswesser et al.
6,271,047 B1 * 8/2001 Ushio et al. ..... 438/14
6,280,289 B1 8/2001 Wiswesser et al.
6,296,548 B1 10/2001 Wiswesser et al.
6,361,646 B1 * 3/2002 Bibby et al. ..... 156/345.1
6,511,363 B2 * 1/2003 Yamane et al. ..... 451/6
6,607,422 B1 8/2003 Swedek et al.
6,618,130 B2 * 9/2003 Chen ..... 356/73
6,664,557 B1 * 12/2003 Amartur ..... 250/559.27
6,747,283 B1 * 6/2004 Amartur ..... 250/559.27
6,812,478 B2 * 11/2004 Amartur ..... 250/559.29
6,991,514 B1 * 1/2006 Meloni et al. ..... 451/5
7,021,991 B2 * 4/2006 Shimizu et al. ..... 451/6
2001/0027080 A1 10/2001 Wiswesser et al.
2001/0036793 A1 11/2001 Wiswesser et al.
2002/0013120 A1 1/2002 Wiswesser et al.
2002/0022936 A1 2/2002 Stanke
2002/0115380 A1 8/2002 Yamane et al.

* cited by examiner

POLISHING STATE MONITORING APPARATUS AND POLISHING APPARATUS AND METHOD

TECHNICAL FIELD

The present invention relates to an apparatus for monitoring a polishing state of a workpiece, and more particularly to a polishing state monitoring apparatus for measuring characteristic values of a surface, being polished, of a workpiece (object to be polished) such as a semiconductor wafer to determine the timing of a polishing end point (stop of polishing or a change in polishing conditions). The present invention also relates to a polishing apparatus incorporating such a polishing state monitoring apparatus, and a polishing method.

BACKGROUND ART

As semiconductor devices have become more highly integrated in recent years, circuit interconnections have become finer and devices to be integrated have been multilayer devices. Therefore, it is necessary to planarize a surface of a semiconductor wafer. It has been customary to remove surface irregularities from the surface of the semiconductor wafer by a chemical mechanical polishing (CMP) process so as to planarize the surface of the semiconductor wafer.

According to the chemical mechanical polishing process, after the semiconductor wafer has been polished for a certain period of time, the polishing needs to be finished at a desired position on the semiconductor wafer. For example, it may be desirable to leave an insulating layer such as $SiO_2$ over a metal interconnection of Cu or Al (such an insulating layer is referred to as an interlayer film because a metal layer will be formed on the insulating layer in a subsequent process). If the semiconductor wafer is polished more than required, then a lower metal film is exposed on the surface. Therefore, the polishing process needs to be finished in order to leave a predetermined thickness of the interlayer film.

According to another process, a predetermined pattern of interconnection grooves is formed in a surface of a semiconductor wafer. After the interconnection grooves are filled up with Cu (copper) or Cu alloy, unnecessary portions are removed from the surface of the semiconductor wafer by the chemical mechanical polishing (CMP) process. When the Cu layer is polished by the CMP process, it is necessary to selectively remove the Cu layer from the semiconductor wafer, while leaving only the Cu layer formed in the interconnection grooves. Specifically, the Cu layer needs to be removed to expose an insulating film of $SiO_2$ or the like in areas other than the interconnection grooves.

In this case, if the Cu layer in the interconnection grooves is excessively polished off together with the insulating layer, then the circuit resistance will be increased, and the entire semiconductor wafer will have to be discarded, resulting in a large loss. Conversely, if the Cu layer is polished insufficiently and remains on the insulating layer, then circuits will not be separated well, thus causing short-circuits. As a result, the Cu layer needs to be polished again, resulting in an increased manufacturing cost.

Thus, there has been known a polishing state monitoring apparatus for measuring the intensity of reflected light with an optical sensor and detecting an end point of the CMP process based on the measured intensity of reflected light. Specifically, the polishing state monitoring apparatus has an optical sensor comprising a light-emitting element and a light-detecting element, and light is applied from the optical sensor to a surface, being polished, of a semiconductor wafer. A change of the reflectance of light in the surface, being polished, of the semiconductor wafer is detected to detect an end point of the CMP process.

The following processes for measuring optical characteristics in the CMP process are known in the art:

(1) Light from a monochromatic light source such as a semiconductor laser, a light-emitting diode (LED), or the like is applied to the surface, being polished, of the semiconductor wafer and a change in the intensity of reflected light is detected.

(2) White light is applied to the surface, being polished, of the semiconductor wafer, and the spectral reflectance thereof is compared with a pre-recorded spectral reflectance at a polishing end point.

In this specification, the spectral reflectance is defined as a term including "spectral reflectance" and "spectral specific reflectance". The spectral reflectance is defined as "ratio of energy of reflected light to energy of incident light". The spectral specific reflectance is defined as "ratio of energy of reflected light from an object to be monitored to energy of reflected light from a reference (for example, bare silicon wafer)".

Recently, there has been developed a polishing state monitoring apparatus for estimating an initial film thickness of a wafer, applying a laser beam to the wafer, and approximating time variation of the measured value of the intensity of reflected light from the wafer with a sine-wave model function to calculate the film thickness.

In the conventional polishing state monitoring apparatus, however, the positions of sampling points on the surface, being polished, of the semiconductor wafer are not controlled, and the sampling points are changed depending on the initial angular position, the rotational acceleration, and steady rotational speed of the polishing table, and the time to start the sampling process. Therefore, characteristic values such as a film thickness at desired positions on the wafer surface, for example, a central line on the wafer or peripheral portion on the wafer cannot be measured. Particularly, if the sampling period is long, then it is difficult to estimate a remaining film profile.

In the above-mentioned polishing state monitoring apparatus which measures the film thickness using the model function, the film thickness is calculated based on an expected initial film thickness and time variation of the measured value of a reflection intensity. Consequently, if the polishing rate varies during the polishing process, or if it is difficult to estimate an initial film thickness, or if an initial film thickness is small, then an accurate model function cannot be determined, thus making it difficult to measure a film thickness.

If the sampling period is long and one sampling point (sampling region) is in a wide range over the surface of the wafer, then various film thicknesses depending on different patterns and removal quantities are measured at one time. Consequently, an accurate model function cannot be determined, and hence it is difficult to measure a film thickness.

In the CMP process, the intensity of reflected light from the surface, being polished, of the wafer varies due to the effect of a slurry (polishing liquid), air bubbles, or mechanical vibrations. Specifically, if a monochromatic light source is used, then fluctuations of the intensity of reflected light directly cause measurement errors. If white light is used, then fluctuations of the spectral reflectance also directly cause errors, thus lowering the accuracy of an end point detection.

SUMMARY OF THE INVENTION

The present invention has been made in view of the above problems in the arts. It is an object of the present invention to provide a polishing state monitoring apparatus and a polishing apparatus incorporating such a polishing state monitoring apparatus, which can accurately and inexpensively measure the state of a film on a workpiece such as a semiconductor wafer that is being polished, and determine the timing of a polishing end point (stop of polishing or a change in polishing conditions).

In order to solve the conventional problems, according to a first aspect of the present invention, there is provided a polishing state monitoring apparatus comprising: a light source; alight-emitting unit disposed in a polishing table having a polishing surface, for applying light from the light source to a surface, being polished, of a workpiece; a light-receiving unit disposed in the polishing table, for receiving reflected light from the surface of the workpiece; a spectroscope unit for dividing the reflected light received by the light-receiving unit into a plurality of light rays having respective wavelengths; light-receiving elements for detecting the light rays divided by the spectroscope unit, and accumulating the detected light rays as electrical information; a spectral data generator for reading the electrical information accumulated by the light-receiving elements and generating spectral data of the reflected light; a control unit for controlling the light-receiving elements to perform a sampling process at a predetermined timing in synchronism with rotation of the polishing table; and a processor for calculating a predetermined characteristic value on the surface of the workpiece based on the spectral data generated by the spectral data generator.

With this arrangement, since the timing of the sampling process performed by the light-receiving elements can appropriately be adjusted, a measuring point can be aligned with a desired position on a path along which the light-emitting unit and the light-receiving unit move across the surface of the workpiece (the path of applied light and reflected light). Thus, each time the polishing table makes a revolution, a characteristic value at a predetermined radial position on the surface of the workpiece can be repeatedly measured. If a sampling period is constant, then the radial position of each sampling point on the surface of the workpiece in each revolution of the polishing table is constant. Therefore, even if it takes time to read and calculate the electrical information accumulated in the light-receiving elements, thus increasing the sampling period, since characteristic values at a plurality of radial positions on the surface of the workpiece can be repeatedly measured, a remaining film profile and the progress of polishing of the surface, being polished, of the workpiece can easily be found. Inasmuch as the sampling period may be long, general-purpose light-receiving elements such as a photodiode array can be used as the light-receiving elements, and hence the polishing state monitoring apparatus can employ an inexpensive optical system.

Furthermore, by dividing the reflected light from the surface, being polished, of the workpiece into a plurality of light rays having respective wavelengths, a characteristic value such as a film thickness can be determined with accuracy without being affected by a change in the polishing rate and an initial film thickness. Even if the sampling period is increased because the plural light rays of respective wavelengths are used, since characteristic values at a plurality of radial positions on the surface of the workpiece can be repeatedly measured, as described above, a remaining film profile and the progress of polishing of the surface, being polished, of the workpiece can easily be grasped.

According to a preferred aspect of the present invention, the control unit controls the timing of the sampling process performed by the light-receiving elements so that a sampling point is located on a line interconnecting the center of the polishing table and the center of the workpiece.

According to a preferred aspect of the present invention, the light-emitting unit and the light-receiving unit pass across the center of the workpiece. By allowing the light-receiving elements to pass across the center of the workpiece and controlling the timing of the sampling process as described above, the center of the workpiece can necessarily be measured as a fixed point each time the polishing table makes one revolution, thus making it possible to accurately grasp time variation of the remaining film of the workpiece.

According to a preferred aspect of the present invention, the control unit is capable of adjusting the sampling period of the sampling process performed by the light-receiving elements based on the rotational speed of the polishing table. Since the sampling period can be adjusted based on the rotational speed of the polishing table, two or more desired radial positions on the surface of the workpiece can be used as sampling points. Therefore, a transition of the remaining film at particular points, such as the center of the wafer and the peripheral portion of the wafer can be seen, and hence the surface of the workpiece can be measured with higher accuracy.

According to a second aspect of the present invention, there is provided a polishing state monitoring apparatus comprising: a light source; a light-emitting unit disposed in a polishing table having a polishing surface, for applying light from the light source to a surface, being polished, of a workpiece; a light-receiving unit disposed in the polishing table, for receiving reflected light from the surface of the workpiece; a spectroscope unit for dividing the reflected light received by the light-receiving unit into a plurality of light rays having respective wavelengths; light-receiving elements for detecting the light rays divided by the spectroscope unit, and accumulating the detected light rays as electrical information; a spectral data generator for reading the electrical information accumulated by the light-receiving elements and generating spectral data of the reflected light; a control unit for controlling the light-receiving elements to perform a sampling process at a predetermined timing in synchronism with rotation of the polishing table; and a processor for calculating a predetermined characteristic value on the surface of the workpiece according to a calculation including a multiplication which multiplies wavelength components of the spectral data generated by the spectral data generator by a predetermined weighting coefficient.

By calculating a characteristic value (index) based on the spectral data, a polishing state can be monitored based on the calculated characteristic value even if an initial film thickness is small or the light transmitting capability of the film is so small that no interference signal is generated. For example, a color of a region corresponding to a sampling point can be converted into a numerical value as a characteristic value, and hence a changing point where a color changes due to the removal of a certain film can be detected. When an upper layer film becomes thin as the polishing process goes on, resulting in a change in the shape of the spectral waveform, a change in the color from moment to moment can be measured, and a polishing end point (stop of polishing or a change in polishing conditions) can be determined based on the characteristic value representing the color. Because the characteristic value can be normalized, the effect of fluctuations in the spectral data can be eliminated.

According to a preferred aspect of the present invention, the characteristic value comprises a chromaticity coordinate value converted from the spectral data. By using a normalized chromaticity coordinate value as the characteristic value, the effect of fluctuations in the spectral data can be eliminated by the normalization. Accordingly, the effect of fluctuations in the spectral data which are caused by instability of the measuring system can be eliminated.

According to a preferred aspect of the present invention, the light source emits light having a wavelength band. Light having a wide wavelength band, such as white light, is emitted from the light source, and the reflected light is divided to obtain a reflection spectrum. Therefore, a film thickness can be calculated without depending on past measured values at respective times unlike a monochromatic light source such as a semiconductor laser, an LED, or the like being used. Accordingly, a characteristic value such as a film thickness can be determined accurately without being affected by a change in the polishing rate and an initial film thickness.

According to a preferred aspect of the present invention, the light source comprises a pulsed light source. By using a pulsed light source as the light source, the range of the measured surface which corresponds to each sampling point can be reduced. Thus, a characteristic value can be calculated more accurately with a less tendency to suffer from the effect of different polishing patterns and polishing rates.

According to a preferred aspect of the present invention, the light source comprises a continuous light source which is continuously turned on at least while said light-receiving elements are detecting the reflected light from said surface of said workpiece. By using the continuous light source as the light source, it is possible to average and read reflected light in a certain zone in which the light-receiving elements scan the surface of the workpiece. Therefore, a general change in the color of the zone can be recognized, producing the time-varied waveform whose high-frequency fluctuations are small.

According to a third aspect of the present invention, there is provided a method of polishing a film formed on a workpiece, comprising: applying light from a light source to a surface, being polished, of a workpiece; detecting reflected light from the surface of the workpiece; dividing the detected light and generating spectral data thereof; multiplying the spectral data by a predetermined weight function and integrating the product to generate a scalar value; calculating a characteristic value of the surface, being polished, of the workpiece using the scalar value; and monitoring the progress of polishing of the surface of the workpiece using the characteristic value.

It is preferable to detect a characteristic point of time variation of the characteristic value, and stop the polishing process or change polishing conditions when a predetermined time has elapsed from the detection of the characteristic point. Further, it is preferable to adjust the weight function using the time variation of the characteristic value. The weight function may be moved along a wavelength axis. Thus, it is possible to adjust the position of an extremal value (peak) as desired for increasing the accuracy of determining a polishing end point. The spectral data may be multiplied by a second weight function different from the above weight function and the product may be integrated to generate a second scalar value, a second characteristic value of the surface, being polished, of the workpiece may be calculated using the second scalar value, and the progress of polishing of the surface of the workpiece may be monitored using the characteristic value and the second characteristic value. Consequently, in monitoring the progress of polishing of the surface of the workpiece, the number of extremal values, i.e., maximum and minimum values can be increased for increasing the accuracy (resolution) of the monitoring process.

According to a fourth aspect of the present invention, there is provided an apparatus for polishing a film formed on a workpiece, comprising: a light source for applying light to a surface, being polished, of a workpiece; a light-receiving unit for receiving reflected light from the surface of the workpiece; a spectroscope unit for dividing the reflected light received by the light-receiving unit; a spectral data generator for generating spectral data from the divided light; and a processor for multiplying the spectral data by a desired weight function and integrating the product to generate a scalar value, and calculating a characteristic value of the surface, being polished, of the workpiece using the scalar value.

According to a preferred aspect of the present invention, an apparatus further comprises an input unit for setting the weight function; and a display unit for monitoring the characteristic value.

According to a preferred aspect of the present invention, there is provided an apparatus, further comprising: a polishing surface; a top ring for holding the workpiece and pressing the surface of the workpiece against the polishing surface; a detector for detecting a characteristic point of a time-varied characteristic value; and a control unit for stopping a polishing process or changing a polishing condition after elapse of a predetermined time from detection of the characteristic point. The processor multiplies the spectral data by a desired second weight function different from said weight function and integrates the product to generate a second scalar value, and calculates a second characteristic value of said surface of the workpiece using the second scalar value. Consequently, in monitoring the progress of polishing of the surface of the workpiece, the number of extremal values, i.e., maximum and minimum values, can be increased for increasing the accuracy (resolution) of a monitoring process.

According to a fifth aspect of the present invention, there is provided a polishing state monitoring apparatus comprising: a light source for applying light to a surface, being polished, of a workpiece; a light-receiving unit for receiving reflected light from the surface of the workpiece; a spectroscope unit for dividing the reflected light received by the light-receiving unit; a spectral data generator for generating spectral data from the divided light; and a processor for multiplying the spectral data by a desired weight function and integrating the product to generate a scalar value, and calculating a characteristic value of the surface, being polished, of the workpiece using the scalar value.

According to a preferred aspect of the present invention, an apparatus further comprises an input unit for setting the weight function and a display unit for monitoring the characteristic value.

According to the present invention, since the timing of the sampling process performed by the light-receiving elements can appropriately be adjusted, a measuring point can be aligned with a desired position on a path along which the light-emitting unit and the light-receiving unit move across the surface of the workpiece (the path of applied light and reflected light). Thus, each time the polishing table makes a revolution, a characteristic value at a predetermined radial position on the surface of the workpiece can be repeatedly measured. If a sampling period is constant, then the radial position of each sampling point on the surface of the workpiece in each revolution of the polishing table is constant. Therefore, even if it takes time to read and calculate the electrical information accumulated in the light-receiving elements, increasing the sampling period, because characteristic values at a plurality of radial positions on the surface of the workpiece can be repeatedly measured, a remaining film profile and the progress of polishing of the surface of the workpiece can easily be grasped. Inasmuch as the sampling period may be long, general-purpose light-receiving elements such as a photodiode array can be used as the light-receiving elements, and hence the polishing state monitoring apparatus can employ an inexpensive optical system.

Furthermore, by dividing the reflected light from the surface, being polished, of the workpiece into a plurality of light rays having respective wavelengths, a characteristic value such as a film thickness can be determined with accuracy without being affected by a change in the polishing rate and an initial film thickness. Even if the sampling period is increased by using the plural light rays of respective wavelengths, because characteristic values at a plurality of radial positions on the surface of the workpiece can be repeatedly measured, as described above, a remaining film profile and the progress of polishing of the surface, being polished, of the workpiece can easily be grasped.

According to the present invention, by calculating a characteristic value (index) based on the spectral data, a polishing state of the workpiece can be monitored based on the calculated characteristic value even if an initial film thickness is small or the light transmitting capability of the film is so small that no interference signal is generated. For example, a color of a region corresponding to a sampling point can be converted into a numerical value as a characteristic value, and hence a changing point where a color changes due to the removal of the film can be detected. When an upper layer film becomes thin as the polishing process goes on, resulting in a change in the shape of the spectral waveform, a change in the color from moment to moment can be measured, and a polishing end point (stop of polishing or a change in polishing conditions) can be determined based on the characteristic value representing the color. Because the characteristic value can be normalized, the effect of fluctuations in the spectral data can be eliminated.

DETAILED DESCRIPTION OF THE INVENTION

Figure 1:
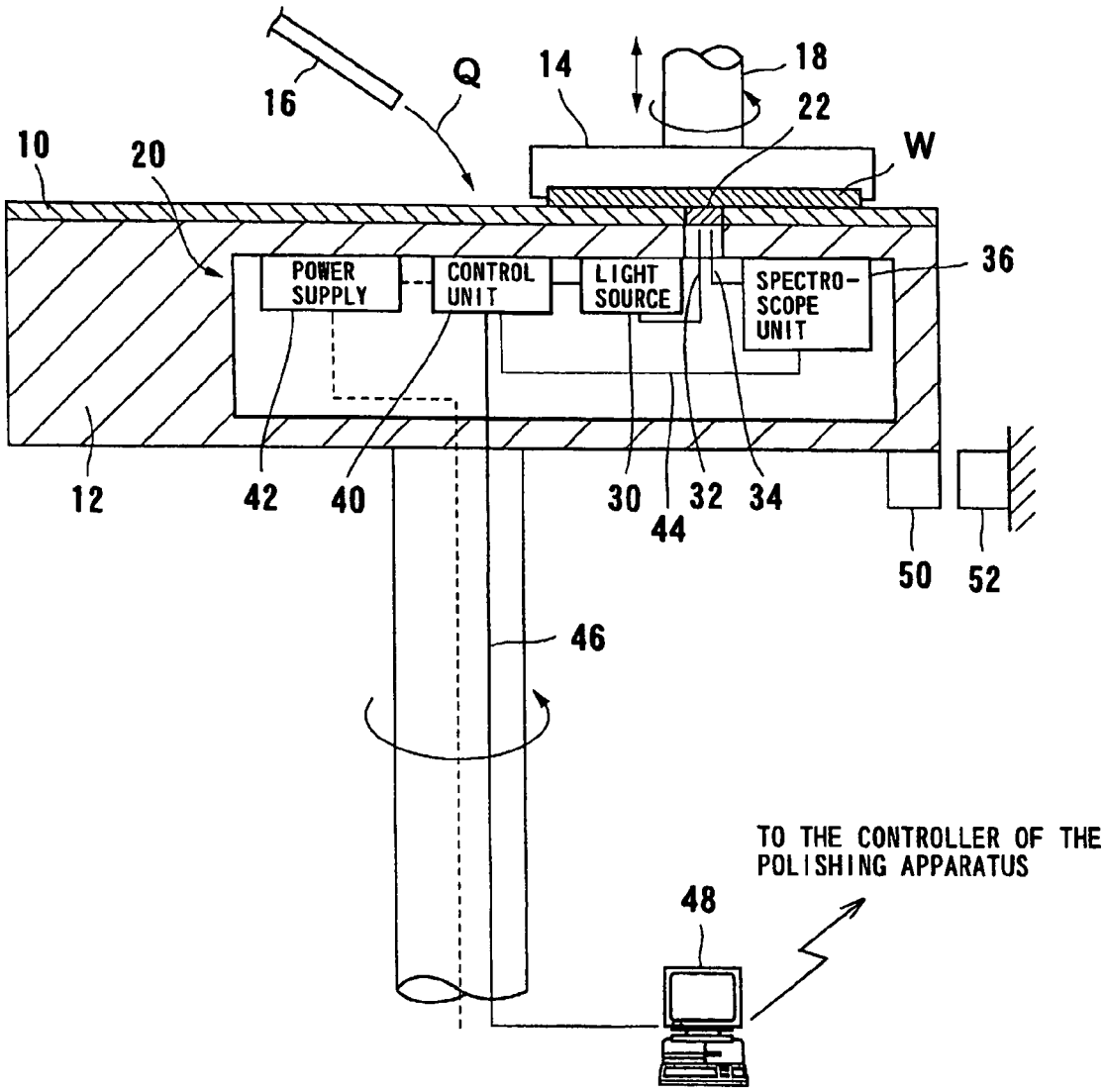
FIG. 1 is a schematic view showing an overall arrangement of a polishing apparatus having a polishing state monitoring apparatus according to an embodiment of the present invention.

An embodiment of a polishing apparatus according to the present invention will be described in detail below with reference to FIGS. 1 through 16. In FIGS. 1 through 16, identical or corresponding components are denoted by identical reference characters, and will not be described repeatedly.

FIG. 1 is a schematic view showing an overall arrangement of a polishing apparatus according to an embodiment of the present invention. As shown in FIG. 1, the polishing apparatus according to the present embodiment has a polishing table 12 with a polishing pad 10 attached to an upper surface thereof, and a top ring 14 for holding a semiconductor wafer W, which is a workpiece (object to be polished), and pressing the semiconductor wafer W against an upper surface of the polishing pad 10. The upper surface of the polishing pad 10 serves as a polishing surface which is brought in sliding contact with the semiconductor wafer W as the object to be polished. The upper surface of a fixed abrasive plate comprising fine abrasive particles (made of $CeO_2$ or the like) fixed by a binder such as resin or the like may be used as a polishing surface.

The polishing table 12 is coupled to a motor (not shown) disposed therebelow, and can be rotated about its own axis as indicated by the arrow. A polishing liquid supply nozzle 16 is disposed above the polishing table 12 and supplies a polishing liquid Q onto the polishing pad 10.

The top ring 14 is coupled to a top ring shaft 18 which is coupled to a motor, and a raising and lowering cylinder (not shown). The top ring 14 can thus be vertically moved as indicated by the arrow and rotated about the top ring shaft 18. The semiconductor wafer W as the object to be polished is attracted to and held by the lower surface of the top ring 14 by a vacuum or the like. With this arrangement, the top ring 14 can press the semiconductor wafer W held by its own lower surface against the polishing pad 10 under a desired pressure, while the top ring 14 rotates about its own axis.

In the polishing apparatus of the above construction, the semiconductor wafer W held by the lower surface of the top ring 14 is pressed against the upper surface of the polishing pad 10 on the rotating polishing table 12. At this time, the polishing liquid Q is supplied onto the polishing pad 10 by the polishing liquid supply nozzle 16. The semiconductor wafer W is polished with the polishing liquid Q being present between the surface (lower surface) of the semiconductor wafer W and the polishing pad 10.

According to the present embodiment, the polishing table 12 has a polishing state monitoring apparatus 20 embedded therein for measuring characteristic values such as film thicknesses and color of an insulating film or a metal film that is formed on the surface of the semiconductor wafer W and monitoring a polishing state while the semiconductor wafer W is being polished. The polishing state monitoring apparatus 20 serves to monitor, continuously in real-time, the polishing situation (thickness and state of the remaining film) of the surface, being polished, of the semiconductor wafer W while the semiconductor wafer W is being polished. A light transmission unit 22 for transmitting light from the polishing state monitoring apparatus 20 therethrough is attached to the polishing pad 10. The light transmission unit 22 is made of a material of high transmittance, e.g., non-foamed polyurethane or the like. Alternatively, the light transmission unit 22 may be in the form of a transparent liquid flowing upwardly into a through hole that is formed in the polishing pad 10 while the through hole is being closed by the semiconductor wafer W. The light transmission unit 22 may be located in any position on the polishing table 12 insofar as it can pass across the surface, being polished, of the semiconductor wafer W held by the top ring 14. However, the light transmission unit 22 should preferably be located in the position where it passes across the center of the semiconductor wafer W.

As shown in FIG. 1, the polishing state monitoring apparatus 20 comprises a light source 30, a light-emitting optical fiber 32 serving as a light-emitting unit for applying light from the light source 30 to the surface, being polished, of the semiconductor wafer W, a light-receiving optical fiber 34 serving as a light-receiving unit for receiving reflected light from the surface, being polished, of the semiconductor wafer, a spectroscope unit 36 for dividing light received by the light-receiving optical fiber 34 and a plurality of photodetectors for storing the light divided by the spectroscope as electrical information, a control unit 40 for controlling energization and de-energization of the light source 30 and the timing to start a reading process of the photodetectors of the spectroscope unit 36, and a power supply 42 for supplying electric power to the control unit 40. The light source 30 and the spectroscope unit 36 are supplied with electric power through the control unit 40.

The light-emitting optical fiber 32 and the light-receiving optical fiber 34 have a light-emitting end and a light-receiving end, respectively, which are arranged to be substantially perpendicular to the surface, being polished, of the semiconductor wafer W. The light-emitting optical fiber 32 and the light-receiving optical fiber 34 are arranged so as not to project upwardly from the polishing surface of the polishing table 12 in consideration of replacement work of the polishing pad 10 and the quantity of light received by the light-receiving optical fiber 34. The photodetectors of the spectroscope unit 36 serves as light-receiving elements and may comprise an array of 512 photodiodes.

The spectroscope unit 36 is connected to the control unit 40 through a cable 44. Information from the photodetectors (light-receiving elements) of the spectroscope unit 36 is transmitted to the control unit 40 by the cable 44. Based on the transmitted information, the control unit 40 generates spectral data of the reflected light. Specifically, the control unit 40 according to the present embodiment serves as a spectral data generator for reading the electrical information stored in the photodetectors and generating spectral data of the reflected light. A cable 46 extending from the control unit 40 extends through the polishing table 12 and is connected to a processor 48 comprising a personal computer, for example. The spectral data generated by the spectral data generator of the control unit 40 are transmitted through the cable 46 to the processor 48.

Based on the spectral data received from the control unit 40, the processor 48 calculates characteristic values of the surface, being polished, of the semiconductor wafer W such as film thicknesses and colors. The processor 48 also has a function-to receive information as to polishing conditions from a controller (not shown) which controls the polishing apparatus, and a function to determine a polishing end point (stop of polishing or a change in polishing conditions) based on time variation of the calculated characteristic values and send a command to the controller of the polishing apparatus.

As shown in FIG. 1, a proximity sensor 50 is mounted on the lower end of the polishing table 12 near its outer circumferential edge, and a dog 52 is installed outwardly of the polishing table 12 in alignment with the proximity sensor 50. Each time the polishing table 12 makes one revolution, the proximity sensor 50 detects the dog 52 to detect a rotation angle of the polishing table 12.

The light source 30 comprises a light source for emitting light having a wavelength range including white light. For example, the light source 30 may comprise a pulsed light source such as a xenon lamp or the like. If the light source 30 comprises a pulsed light source, then the light source 30 is energized in a pulsed fashion by a trigger signal at each measuring point during a polishing process. Alternatively, the light source 30 may comprise a tungsten lamp and maybe continuously energized at least while the light-emitting end of the light-emitting optical fiber 32 and the light-receiving end of the light-receiving optical fiber 34 are facing the surface, being polished, of the semiconductor wafer W.

Light from the light source 30 passes through the light-emitting end of the light-emitting optical fiber 32 and the light transmission unit 22, and is applied to the surface, being polished, of the semiconductor wafer W. The light is reflected by the surface, being polished, of the semiconductor wafer W, passes through the light transmission unit 22, and is received by the light-receiving optical fiber 34 of the polishing state monitoring apparatus. The light received by the light-receiving optical fiber 34 is transmitted to the spectroscope unit 36, which divides the light into a plurality of light rays having respective wavelengths. The divided light rays having respective wavelengths are applied to the photodetectors corresponding to the wavelengths, and the photodetectors store electric charges depending on the applied quantities of the light rays. The electrical information stored in the photodetectors is read (released) at a predetermined timing, and converted into a digital signal. The digital signal is sent to the spectral data generator of the control unit 40, and the control unit 40 generates spectral data corresponding to respective measuring points.

Figure 2:
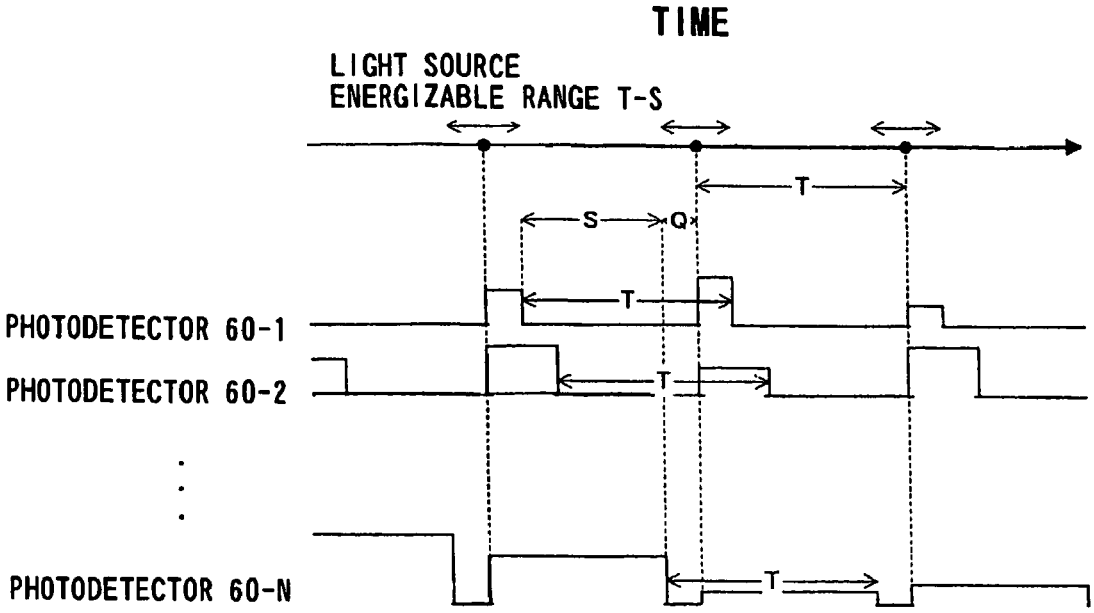
FIG. 2 is a diagram showing the operation of light-receiving elements in a spectroscope unit in a case where a pulsed light source is used in the polishing state monitoring apparatus shown in FIG. 1.
Figure 3:
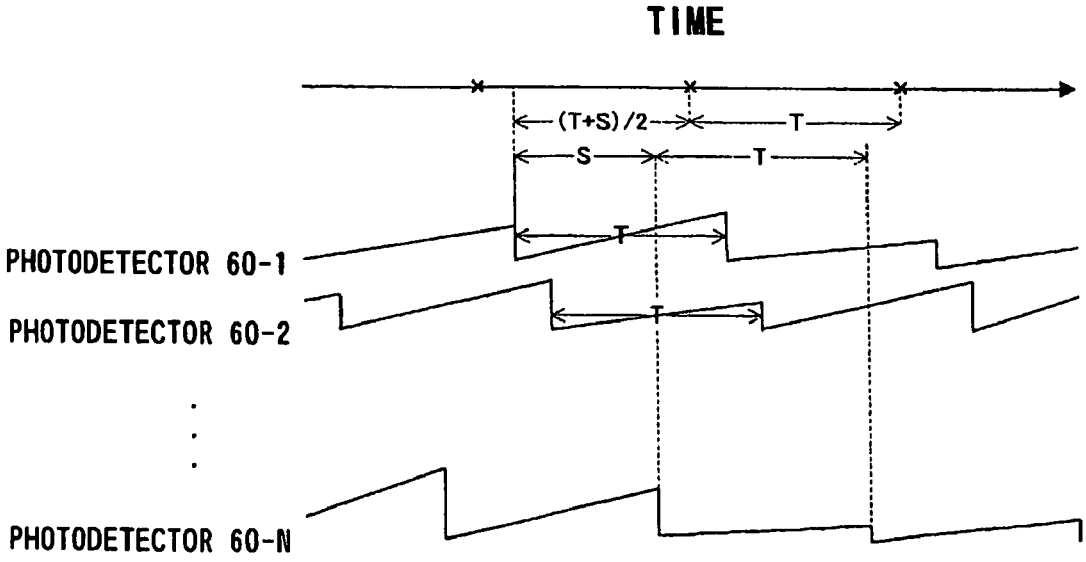
FIG. 3 is a diagram showing the operation of light-receiving elements in a spectroscope unit in a case where a continuous light source is used in the polishing state monitoring apparatus shown in FIG. 1.

Operation of the photodetectors of the spectroscope unit 36 will be described below. FIGS. 2 and 3 are diagrams showing the manner in which the photodetectors operate in a case where the spectroscope unit 36 comprises N photodetectors 60-1 through 60-N. FIG. 2 shows a mode of operation when the light source 30 comprises a pulsed light source, and FIG. 3 shows a mode of operation when the light source 30 comprises a continuous light source. In FIGS. 2 and 3, the horizontal axis represents time. In the lines representing the respective photodetectors, rising portions show that electrical information is stored in the photodetectors, and falling portions show that electrical information is read (released) from the photodetectors. In FIG. 2, solid circles (●) indicate times when the pulsed light source is energized.

In one sampling cycle, the photodetectors 60-1 through 60-N are successively switched to read (release) electrical information therefrom. As described above, the photodetectors 60-1 through 60-N store the quantities of light rays of the corresponding wavelengths as electrical information, and the stored electrical information is repeatedly read (released) from the photodetectors 60-1 through 60-N at a sampling period T with phase difference therebetween. The sampling period T is set to a relatively small value insofar as sufficient quantities of light are stored as electrical information in the photodetectors 60-1 through 60-N and data read from the photodetectors 60-1 through 60-N can sufficiently be processed in real-time. If the photodetectors comprise an array of 512 photodiodes, then the sampling period T is on the order of 10 milliseconds. In FIGS. 2 and 3, a time S elapses after the first photodetector 60-1 is read until the last photodetector 60-N is read, where S<T. In FIG. 2, the time (indicated by ● in FIG. 2) when the pulsed light source is energized serves as a sampling time. In FIG. 3, the time (indicated by x in FIG. 3) that is half the time after the first photodetector 60-1 is read and starts storing new electrical information until the last photodetector 60-N is read serves as a sampling time for corresponding measuring areas. Points on the semiconductor wafer which face the light transmission unit 22 at the sampling times are referred to as sampling points.

In FIG. 2, all the photodetectors 60-1 through 60-N store light while the light source 30 is instantaneously energized (for about several microseconds). Assuming that the time after the electrical information stored in the last photodetector 60-N is read (released) until the light source 30 is energized is represented by Q, then 0<Q<T−S if the light source 30 is energized before the electrical information stored in the first photodetector 60-1 is read (released). Q may be of any value in the range indicated by the above inequality. However, it is assumed below that Q=(T−S)/2. The first photodetector 60-1 is read and starts storing new electrical information at a timing that is earlier than the sampling time by S+Q, i.e., (T+S)/2. In FIG. 3, the first photodetector 60-1 is also read at a timing that is earlier than the sampling time by (T+S)/2. With respect to the continuous light source shown in FIG. 3, since the photodetectors 60-1 through 60-N start storing electrical information at different times, respectively, and the stored electrical information is read from the photodetectors 60-1 through 60-N at different times, respectively, actual measuring areas differs lightly depending on the wavelengths.

Figure 4:
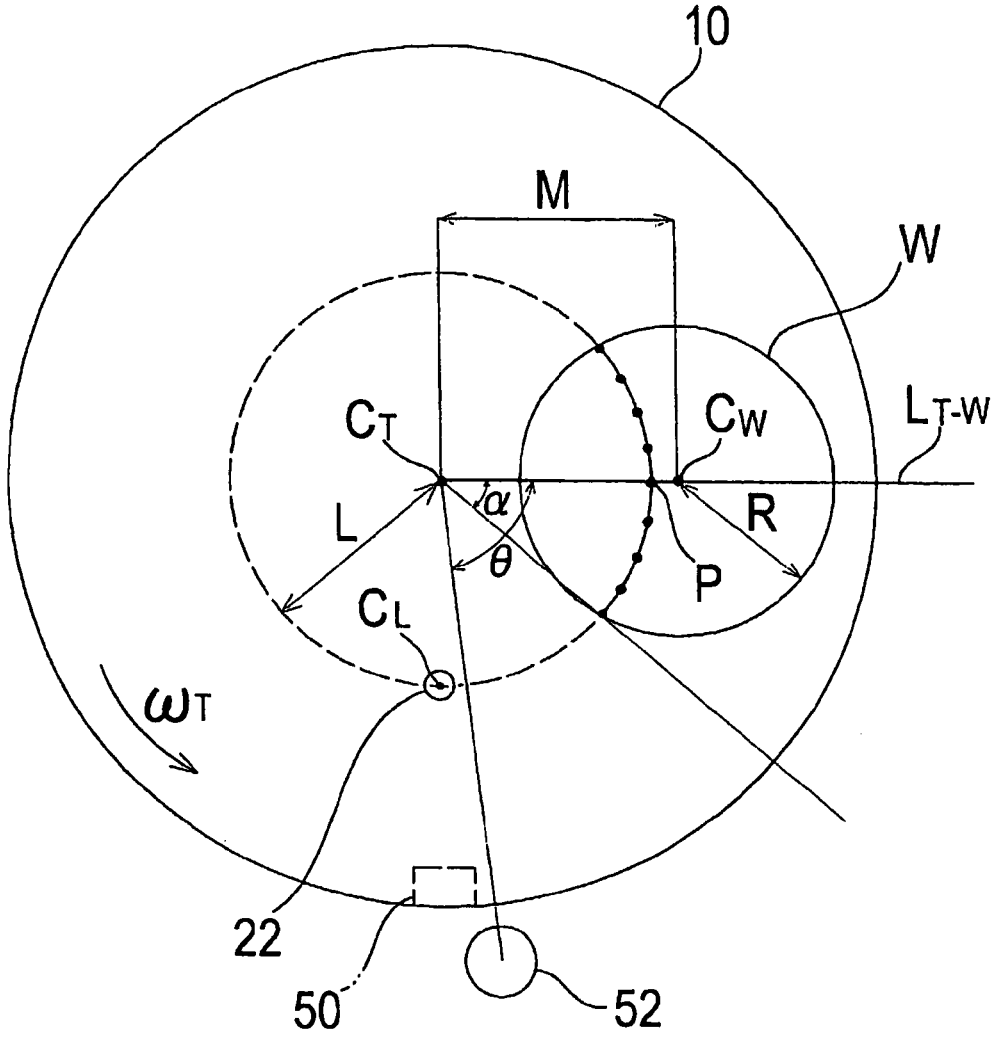
FIG. 4 is a plan view illustrative of sampling timings of the polishing state monitoring apparatus shown in FIG. 1.

Next, processes of determining a sampling timing with the polishing state monitoring apparatus 20 will be described below. First, a process of determining a sampling timing in a case where the pulsed light source is employed will be described below. FIG. 4 is a view illustrative of sampling timings of the polishing state monitoring apparatus 20. Each time the polishing table 12 makes one revolution, the proximity sensor 50 disposed on the outer circumferential edge of the turntable 12 detects the dog 52 which serves as a reference position for triggering the proximity sensor 50. Specifically, as shown in FIG. 4, a rotation angle is defined as an angle, in a direction opposite to the direction in which the polishing table 12 rotates, from a line $L_{T\text{-}W}$ (hereinafter referred to as a wafer center line) that interconnects the center $C_T$ of rotation of the polishing table 12 and the center $C_W$ of the semiconductor wafer W. The proximity sensor 50 detects the dog 52 when the rotation angle is θ. The center $C_W$ of the semiconductor wafer W can be specified by controlling the position of the top ring 14.

As shown in FIG. 4, if it is assumed that the horizontal distance between the center $C_T$ of the polishing table 12 and the center $C_L$ of the light transmission unit 22 is represented by L, the horizontal distance between the center $C_T$ of the polishing table 12 and the center $C_W$ of the semiconductor wafer W is represented by M, the radius of a surface, being measured, of the semiconductor wafer W which is equal to the surface, being polished, of the semiconductor wafer W exclusive of a cut edge region thereof is represented by R, and the angle at which the light transmission unit 22 scans the surface, being measured, of the semiconductor wafer W is represented by 2α, then the following equation (1) is satisfied based on the cosine theorem for determining the angle α:

$$\alpha = \cos^{-1}\left(\frac{L^2 + M^2 - R^2}{2LM}\right) \tag{1}$$

According to the present embodiment, sampling timings are adjusted such that a point P on the wafer center line $L_{T\text{-}W}$ where the light transmission unit 22 passes is necessarily a sampling point. If the number of sampling points on one side of the wafer center line $L_{T\text{-}W}$ is n (an integer), then the number of all sampling points while the light transmission unit 22 is scanning the surface, being measured, of the semiconductor wafer W is indicated by 2n+1, including the sampling point P on the wafer center line $L_{T\text{-}W}$.

If the outer circumferential region of the top ring 14 is positioned outwardly of the semiconductor wafer W so as to block background light, then the condition for the light transmission unit 22 to be present within the surface, being measured, of the semiconductor wafer W at a first sampling time can be expressed by the inequality (2) shown below, where $\omega_T$ represents the angular velocity of the polishing table 12. The integer n which satisfy the condition can be determined from the inequality (2).

$$\alpha - \omega_T T \leqq n\omega_T T < \alpha \tag{2}$$

That is,

-continued $$\frac{\alpha}{\omega_T T} - 1 \leqq n < \frac{\alpha}{\omega_T T}$$

If the light transmission unit 22 and the proximity sensor 50 are positioned at the same angle with respect to the center $C_T$ of the polishing table 12, then when the polishing table 12 makes one revolution, a time $t_S$ after the proximity sensor 50 detects the dog 52 until the first photodetector 60-1 starts storing electrical information in the first sampling cycle, i.e., a sampling start time $t_S$, can be determined according to the following equation (3):

$$t_S = \frac{\theta}{\omega_T} - \left(nT + \frac{T+S}{2}\right) = \frac{\theta}{\omega_T} - \left(n + \frac{1}{2}\right)T - \frac{S}{2} \quad (3)$$

In order to reliably clear the quantity of light stored in the photodetectors while the light transmission unit 22 is present outside of the surface, being polished, of the semiconductor wafer W, the data acquired in the first sampling cycle may be discarded. In this case, the sampling start time $t_S$ can be determined according to the following equation (4):

$$t_S = \frac{\theta}{\omega_T} - \left(nT + \frac{T+S}{2} + T\right) = \frac{\theta}{\omega_T} - \left(n + \frac{3}{2}\right)T - \frac{S}{2} \quad (4)$$

The polishing state monitoring apparatus 20 starts its sampling process based on the sampling start time $t_S$ thus determined. Specifically, the control unit 40 starts pulse lighting of the light source 30 after elapse of the time $t_S$ from the detection of the dog 52 by the proximity sensor 50, and controls the operation timing of the photodetectors of the spectroscope unit 36 to repeat a sampling cycle at each sampling period T. Reflected spectral data at each sampling point is generated by the spectral data generator of the control unit 40 and transmitted to the processor 48. Based on the spectral data, the processor 48 determines a characteristic value of the surface, being polished, of the semiconductor wafer W, e.g., a film thickness.

According to the present embodiment, since the point P on the wafer center line $L_{T\text{-}W}$ where the light transmission unit 22 passes is necessarily a sampling point, the characteristic value at a given radial position on the surface of the object can repeatedly be measured each time the polishing table 12 makes one revolution. If the sampling period is constant, then the radial positions of measuring points on the surface of the object per revolution of the polishing table 12 become constant. Therefore, this measuring process is more advantageous in recognizing the situation of a remaining film on the semiconductor wafer W than the case where the characteristic values at indefinite positions are measured. In particular, if the light transmission unit 22 is arranged to pass through the center $C_W$ of the semiconductor wafer W, then the center $C_W$ of the semiconductor wafer W is necessarily measured as a fixed point each time the polishing table 12 makes one revolution, resulting in a more accurate recognition of a time-varied remaining film situation on the semiconductor wafer W.

If the light source 30 comprises a continuous light source, then since the respective photodetectors continuously store electrical information and start storing the electrical information at different times, the integer n is determined in a manner different from a pulsed light source. Specifically, when the first photodetector 60-1 starts storing electrical information, the light transmission unit 22 needs to be present in the surface, being measured, of the semiconductor wafer W. Therefore, the inequality for determining the integer n is given as follows:

$$\alpha - \omega_T T \leqq n\omega_T T + \omega_T \frac{T+S}{2} < \alpha \quad (5)$$

That is, $$\frac{\left(\frac{\alpha}{\omega_T} - \frac{S}{2}\right)}{T} - \frac{3}{2} \leqq n < \frac{\left(\frac{\alpha}{\omega_T} - \frac{S}{2}\right)}{T} - \frac{1}{2}$$

The integer n can be determined from the above inequality (5), and the sampling start time $t_S$ can be determined based on the equation (3) or (4). As with the pulsed light source, the polishing state monitoring apparatus 20 starts its sampling process based on the determined sampling start time $t_S$, and determines a characteristic value of the surface, being polished, of the semiconductor wafer W, e.g., a film thickness, from spectral data at each sampling point. In the above example, certain conditions are established with respect to the timing to energize the pulsed light source and the positional relationship between the light transmission unit 22 and the proximity sensor 50. Even if these conditions are not met, n and $t_S$ can similarly be determined.

Next, a process of calculating a film thickness as a characteristic value from spectral data at each sampling point will be described below. In the present embodiment, if spectral data are expressed in terms of the wave number (the number of waves per unit length) of the obtained spectral data represented by a horizontal axis and the intensity of light represented by a vertical axis, then a film thickness is calculated based on the fact that the period of spectral data (the number of waves between peaks) with respect to one film thickness is proportional to the film thickness.

Figure 5:
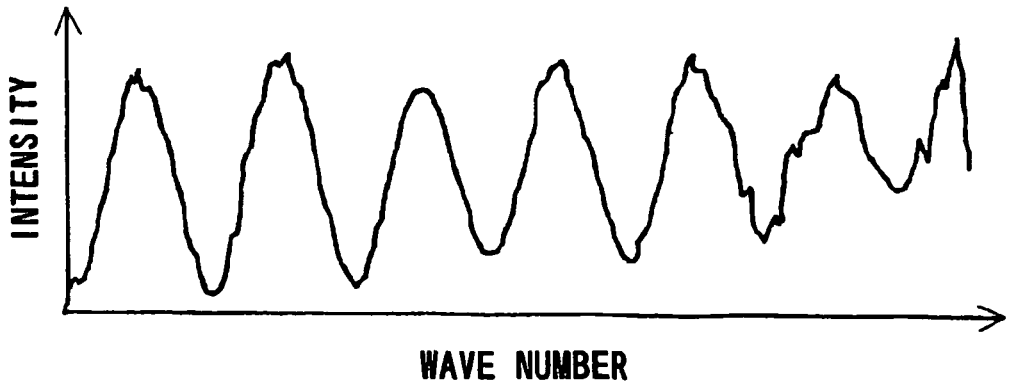
FIG. 5 is a graph showing spectral data produced by the polishing state monitoring apparatus according to the present invention.

For example, it is assumed that the obtained spectral data have a waveform as shown in FIG. 5. The spectral waveform shown in FIG. 5 reveals the following facts:

(1) There is an interference wave pattern having a constant period.

(2) There is an offset.

(3) There is a substantially linear drift that increases to the right.

(4) Because of an interference efficiency, the amplitude of an interference wave is smaller as the wave number is greater.

In view of the above facts, if the period ω of the interference wave is known, then it is expected that the spectral waveform can be approximated by the following function f(x):

$$f(x) = \alpha_0 + \alpha_1 x + \alpha_2\left(\frac{1}{x}\right)\sin(\omega x + \delta) \quad (6)$$

On the right side of the equation (6), the first term reflects the offset of the spectral waveform, the second term reflects the drift of the spectral waveform, and the third term reflects the periodic waveform of the spectral waveform. More specifically, in the third term, (1/x) reflects a reduction in the amplitude caused by an increase in the wave number, and δ reflects a phase shift that becomes prominent if the film thickness is large.

The following equation (7) is satisfied according to the addition theorem:

$$\sin(\omega x+\delta)=\sin \omega x\cdot\cos \delta+\cos \omega x\cdot\sin \delta \tag{7}$$

Therefore, the equation (6) can be modified as follows:

$$f(x) = \alpha_0 + \alpha_1 x + \alpha_2\left(\frac{1}{x}\right)\sin\omega x + \alpha_3\left(\frac{1}{x}\right)\cos\omega x \tag{8}$$

If $f_0(x)=1$, $f_1(x)=x$, $f_2(x)=(1/x)\sin \omega x$, and $f_3(x)=(1/x)\cos \omega x$, then the measured spectrum can be approximated as the linear sum of these four functions by a function f(x) according to the following equation (9):

$$f(X)=\alpha_0 f_0(x)+\alpha_1 f_1(x)+\alpha_2 f_2(x)+\alpha_3 f_3(x) \tag{9}$$

Figure 6:
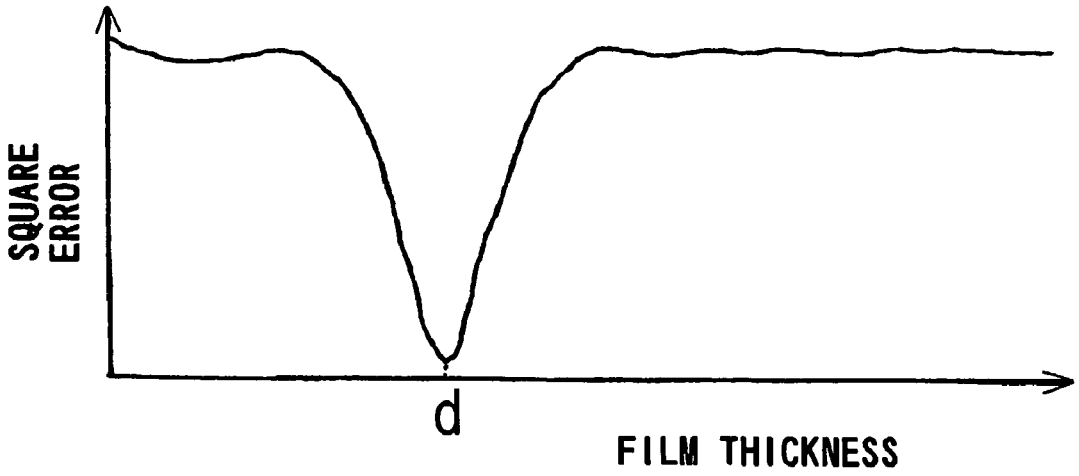
FIG. 6 is a graph showing the relationship between a film thickness and a least square error of a spectral approximation, which is used in the polishing state monitoring apparatus according to the present invention.
Figure 7:
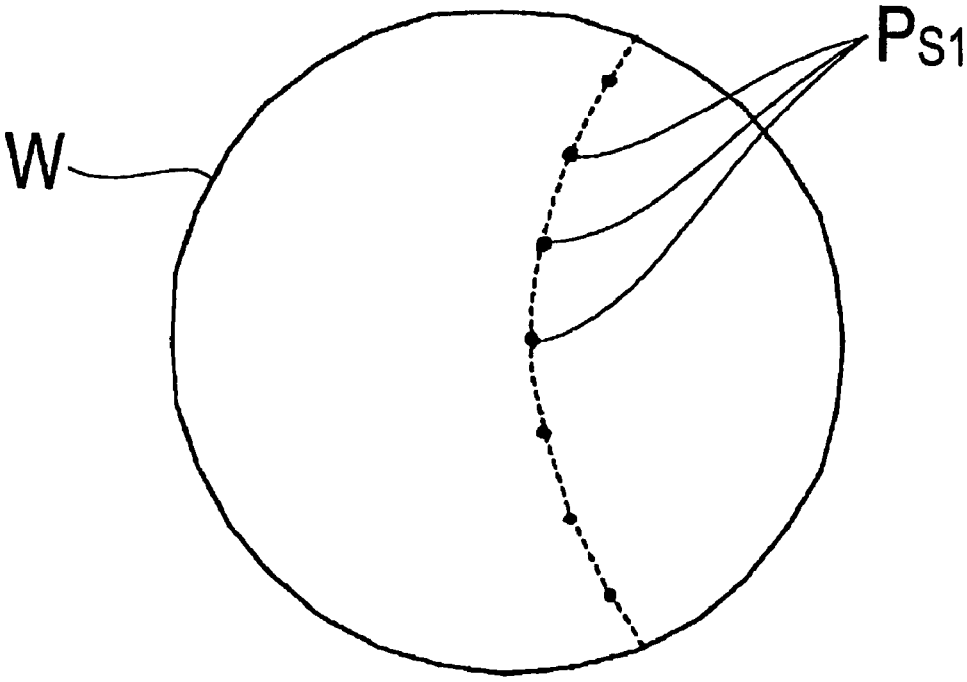
FIG. 7 is a plan view showing measurement points in a case where a pulsed light source is used in the polishing state monitoring apparatus according to the present invention.

If the approximate function f(x) is optimally approximated with respect to the measured spectrum, then the square error therebetween becomes minimum. Thus, an approximate function f(x) on the assumption of a certain film thickness is defined, coefficients $\alpha_0$, $\alpha_1$, $\alpha_2$ and $\alpha_3$ of the function f (x) are determined so as to minimize the square error between the approximate function f(x) and the measured spectrum, and the least square error at this time is determined. The above calculation is conducted while changing the film thickness, and the results are plotted in a graph having a horizontal axis representative of film thickness values and a vertical axis representative of least square errors. As a result, a graph shown in FIG. 6 is produced. As shown in FIG. 6, the graph has a minimum point (peak top) of the least square error, and the approximate function f(x) at the minimum point is of a shape closest to the measured spectrum. Therefore, a film thickness (film thickness d in FIG. 6) corresponding to this approximate function f(x) is calculated as a film thickness to be determined.

While in the measuring process, the polishing table 12 and the light transmission unit 22 move over the surface, being polished, of the semiconductor wafer W. If the rotational speed of the polishing table 12 or the top ring 14 and the sampling period T are large, then the scanning range per a sampling point is large. Consequently, if the light source 30 is continuously energized when the pattern and the polishing rate differ depending on the position on the surface, being polished, of the semiconductor wafer W, various film thicknesses are measured at one time at one sampling point. Consequently, no clear interference spectrum is obtained, and as a result, the clear peak top as shown in FIG. 6 may not be produced. In view of this shortcoming, it is preferable to use a pulsed light source which is energized for several microseconds as the light source 30. If such a pulsed light source is used, then small discrete spots $P_{S1}$ on the surface, being polished, of the semiconductor wafer W can be measured as measuring points, and film thicknesses in the respective measuring points can accurately be measured.

In the above example, a film thickness is calculated as a characteristic value. The characteristic value to be calculated is not limited to a film thickness. Depending on the material of the workpiece (object to be polished), the color of the object may change greatly when an upper-layer film is removed from the object. For example, when a copper film on the workpiece is removed, a color with a red gloss may disappear from the workpiece. Therefore, a change in the color of the surface, being polished, of the workpiece may be used as an index for recognizing the state of the surface being polished. In view of the above characteristics, a process of calculating a color as a characteristic value from spectral data at respective sampling points will be described below.

Figure 8:
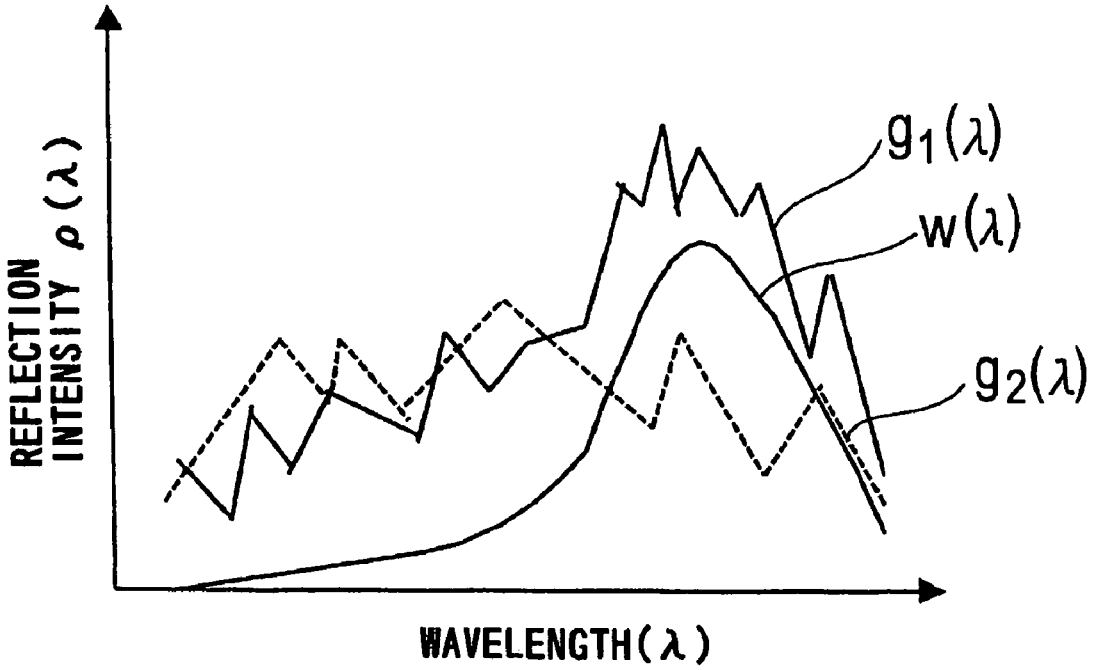
FIG. 8 is a graph illustrative of a weight function used in the polishing state monitoring apparatus shown in FIG. 1.

As shown in FIG. 8, spectral data $g_1(\lambda)$, $g_2(\lambda)$ before and after a polishing end point (stop of polishing or a change in polishing conditions) are compared with each other, and a weight function $w(\lambda)$ having a larger value for a larger change in a wavelength range is defined in advance. Measured values $\rho(\lambda)$ of spectral data of reflected light at respective wavelengths $\lambda$ are multiplied by the weight function $w(\lambda)$, and the results are added, i.e., integrated into a scalar value. The resultant scalar value is taken as a characteristic value X. Specifically, the characteristic value X is defined according to the following equation (10):

$$X = \sum_{\lambda} w(\lambda)\rho(\lambda)\Delta\lambda \tag{10}$$

Alternatively, a plurality of weight functions $w_i(\lambda)$ (i=1, 2, . . . ) may be defined, and the characteristic value $X_i$ may be defined according to the following equation (11):

$$X_i = \frac{\sum_{\lambda} w_i(\lambda)\rho(\lambda)\Delta\lambda}{\sum_{i}\sum_{\lambda} w_i(\lambda)\rho(\lambda)\Delta\lambda} \tag{11}$$

According to the above process, even when the upper-layer film becomes thinner and the spectral waveform changes its shape as the polishing process progresses, a change in the color may be measured from moment to moment, and a polishing end point (stop of polishing or a change in polishing conditions) can be determined based on the characteristic value of the color.

In the equation (10), if the weight function $w(\lambda)$ is defined as $w(\lambda_0)=1$, $w(\lambda)=0$ $(\lambda\neq\lambda_0)$, $\Delta\lambda=1$, then a characteristic value X representative of the spectral value at the wavelength $\lambda_0$ can be obtained. If the weight function $w(\lambda)$ is defined as $w(\lambda_1)=1$, $w(\lambda_2)=-1$, $w(\lambda)=0$ $(\lambda\neq\lambda_1, \lambda_2)$, $\Delta\lambda=1/(\lambda_1-\lambda_2)$, then a characteristic value X representative of the gradient of the straight line that interconnects the wavelengths $\lambda_1$, $\lambda_2$ in the spectral graph can be obtained. The measured values $\rho(\lambda)$ of spectral data may be averaged in advance in the vicinity of the respective wavelengths to reduce the effect of noise.

The measured spectral data $\rho(\lambda)$ may be of a spectrum of quantities of reflected light at respective wavelengths or a relative spectral reflectance normalized by (either of) a spectrum of a reference reflecting plate or a spectrum immediately after the measuring process starts.

The weight function $w(\lambda)$ maybe defined to match JIS-Z-8701. Specifically, spectral data (spectral reflectance) which has been converted into chromaticity coordinates (x, y) may also be used as a characteristic value. A process of converting spectral data into chromaticity coordinates (x, y) and using the converted chromaticity coordinates (x, y) as a characteristic value will be described below. Tristimulus values X, Y, Z of color of a reflective object are calculated according to the following equations (12) through (14):

$$X=k\int_{380}^{780}P(\lambda)\bar{x}(\lambda)\rho(\lambda)d\lambda \tag{12}$$

$$Y=k\int_{380}^{780}P(\lambda)\bar{y}(\lambda)\rho(\lambda)d\lambda \quad (13)$$

$$Z=k\int_{380}^{780}P(\lambda)\bar{z}(\lambda)\rho(\lambda)d\lambda \quad (14)$$

$\bar{x}(\lambda),\bar{y}(\lambda),\bar{z}(\lambda)$: color matching functions based on the 2-degree field-of-view XYZ system, where $\lambda$ represents the wavelength, $P(\lambda)$ the spectral distribution of an assumed light source, k a coefficient that is determined to equalize the stimulus value Y to a photometric quantity, and $\rho(\lambda)$ a measured spectral distribution. The measured spectral distribution $\rho(\lambda)$ can be defined according to the following equation (15), for example:

$$\rho(\lambda) = \frac{\rho_M(\lambda)}{\rho_B(\lambda)} \quad (15)$$

where $\rho_M(\lambda)$ represents a measured spectral distribution and $\rho_B(\lambda)$ represents a reflected spectral distribution for bare silicon.

Proportions x, y, z of X-component, Y-component, and Z-component are determined from the stimulus values X, Y, Z according to the following equations (16) through (18):

$$x = \frac{X}{X+Y+Z} \quad (16)$$

$$y = \frac{Y}{X+Y+Z} \quad (17)$$

$$z = \frac{Z}{X+Y+Z} \quad (18)$$

The proportions x, y, z thus determined are called chromaticity coordinates. Of the proportions x, y, z, only two are independent. Therefore, a combination of x, y is usually used as chromaticity coordinate values (x, y).

In this manner, spectral data can be converted into chromaticity coordinate values (x, y), and a polishing endpoint (stop of polishing or a change in polishing conditions) can be determined based on either one or both of the chromaticity coordinate values (x, y). The chromaticity coordinate values can be regarded as a special case of the equation (11). As with the equation (11), the chromaticity coordinate values are normalized as indicated by the equations (16) through (18). Consequently, the effect of fluctuations of the spectral reflectance can be eliminated by the normalization. In this manner, by using the chromaticity coordinate values as a characteristic value, it is possible to eliminate the effect of fluctuations of the spectral reflectance which are caused by instability of the measuring system.

By setting the color matching functions in the equations (12) through (14) and the spectral distribution of the light source as parameters, the weighting of a wavelength range which has more changes in the spectral reflectance due to polishing can be optimized for each wafer. Therefore, the state of the surface, being polished, of the wafer can be measured more accurately.

Next, a specific example in which a predetermined characteristic value on the surface, being polished, of the workpiece is calculated by calculations including a multiplication that multiplies wavelength components of spectral data generated by the spectral data generator by a predetermined weight function to monitor the progress of polishing will be described below.

For determining a characteristic value according to the equations (10), (11), and the like, it is of importance how to define the weight function $w(\lambda)$. It is preferable that the weight function $w(\lambda)$ can be adjusted depending on the purpose.

For example, if the film to be polished is a metal film that is largely different in color from the base layer, and a time to remove the film is to be recognized, then a weight function having a large weight in a wavelength band corresponding to the color of the film to be removed is defined. For example, if the film to be polished is a copper film, then since the copper film has a red gloss and provides a large reflection intensity at a wavelength of about $\lambda$=800 nm, the weight function $w(\lambda)$ is defined to have a large weight in the vicinity of $\lambda$=800 nm. A characteristic value X is determined according to the equation (10) as follows:

$$X = \sum_{\lambda} w(\lambda)\rho(\lambda)\Delta\lambda$$

The characteristic value X has its value which varies greatly depending on whether there is a copper film or not. Even if a disturbance occurs at a certain wavelength of the first spectral data $\rho(\lambda)$, since the integral operation is performed, the effect of the disturbance is smaller compared to the case where the reflection intensity at $\lambda$=800 nm is directly monitored.

Using the equation (11), i is set to i=1, 2, and the weight function $w_1(\lambda)$ is defined to have a large weight in the vicinity of $\lambda$=800 nm, and the weight function $w_2(\lambda)$ is defined to have a large weight in a wavelength band having a substantially constant reflection intensity regardless of whether there is a copper film or not. At this time, a characteristic value:

$$X_1 = 1\Big/\left\{1 + \sum_{\lambda} w_2(\lambda)\rho(\lambda)\Delta\lambda \Big/ \sum_{\lambda} w_1(\lambda)\rho(\lambda)\Delta\lambda\right\}$$

has its value which varies greatly depending on whether there is a copper film or not. Furthermore, even if the quantity of reflected light increases or decreases depending on the disturbance, it is possible to obtain a waveform whose time variation is stable.

For detecting a polishing end point (stop point of polishing or a change in polishing conditions such as pressing forces applied respectively to a plurality of pressing areas provided in the top ring or types of slurry (polishing liquid)), a characteristic point (a predetermined threshold, starting or ending of an increase or decrease, an extremal value, or the like) of time variation of the characteristic value which appears in the manner as described above is detected, and the film is overpolished for a predetermined time, and then the polishing operation is switched. The overpolishing time may be zero.

Next, a specific example of a process of adjusting a weight function in the case where the film to be polished is a light-transmissive film such as an oxide film or the like will be described below.

Figure 9:
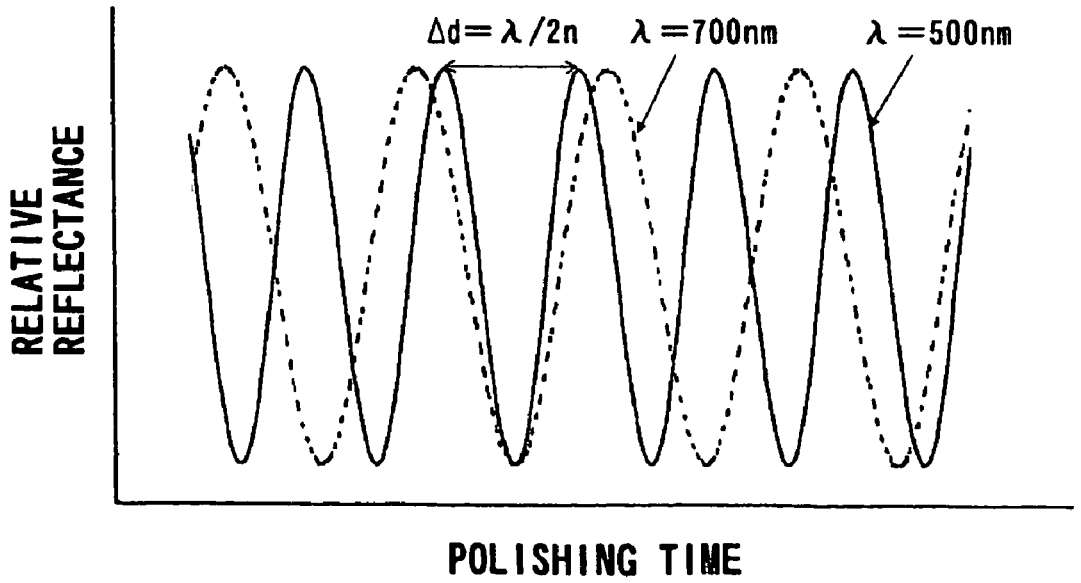
FIG. 9 is a graph illustrative of a time-varied relative reflectance while an oxide film is being polished, which are used in the polishing state monitoring apparatus according to the present invention.

If the film to be polished is a light-transmissive film such as an oxide film or the like, and has a uniform thickness and is in a disturbance-free ideal state, then time variation of relative reflectances at respective wavelengths are as shown in FIG. 9 because of an interference caused by the film to be polished. If the film to be polished has a refractive index n and a film thickness d, and light has a wavelength λ (in vacuum), then a film thickness difference corresponding to one period of the time variation is represented by $\Delta d=\lambda/2n$. Therefore, if the film thickness decreases linearly with the polishing time, the relative reflectance changes with time such that its maximum and minimum values appear periodically, as shown in FIG. 9. In FIG. 9, the solid-line curve represents a relative reflectance at a wavelength λ=500 nm, and the broken-line curve represents a relative reflectance at a wavelength λ=700 nm.

A study of FIG. 9 indicates that as the wavelength of light is shorter, the period of time variation of the relative reflectance is shorter, and extremal values more frequently occur. Therefore, with regard to time variation of the characteristic value that is calculated by calculations including a multiplication that multiplies wavelength components of spectral data by the weight function, the period of such time variation is expected to be shorter with more extremal values as the wavelength in question of the weight function is shorter.

Figure 10:
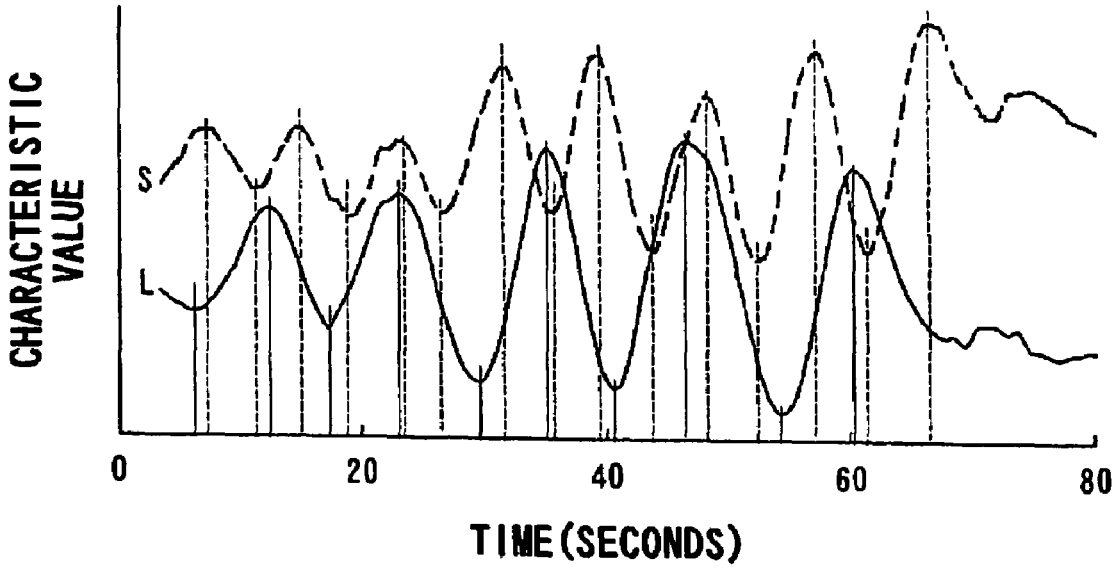
FIG. 10 is a graph illustrative of changes in the period of a characteristic value due to different weight function wavelength ranges, which are used in the polishing state monitoring apparatus according to the present invention.

FIG. 10 shows an example in which a characteristic value $X_3$ is monitored according to the equation (11) when an oxide film on an interconnection pattern is polished. The characteristic value is calculated using sets L, S of three weight functions $w_1(\lambda)$, $w_2(\lambda)$, $w_3(\lambda)$ shown in FIG. 11. The characteristic value repeatedly increases and decreases up to about 70 seconds, and then the behavior of the characteristic value is changed. Since the characteristic value is basically considered to increase and decrease due to an interference of light based on a reduction in the thickness of the film being polished, it is presumed that the interconnection pattern or part of the interconnection pattern is exposed in about 70 seconds, preventing the characteristic value from increasing and decreasing.

For monitoring the characteristic value, maximum and minimum values of time variation of the characteristic value are detected to indicate the progress of polishing. If the polishing process is stopped at the time an extremal value is detected and the film thickness is measured as a reference, then the progress of polishing can be related to the thickness of the film being polished. Therefore, as the period of time variation of the characteristic value is shorter, resolution is high and fine monitoring can be made.

In the example shown in FIG. 10, the characteristic value for L has 10 extremal values and the characteristic value for S has 15 extremal values. According to the characteristic value for L, the polishing process can be recognized in 11 divided zones. According to the characteristic value for S, the polishing process can be recognized in 16 divided zones.

For a polishing end point (stop point of polishing or a change in polishing conditions), an extremal value (one characteristic point) immediately before a desired film thickness is reached is detected, and the film is overpolished for a time which corresponds to the difference between the film thickness at the extremal value and the desired film thickness. Therefore, as the period of time variation of the characteristic value is shorter, the overpolishing time is shorter, thus increasing the accuracy of an endpoint detection. As described above, by setting the weight function to a short-wavelength band, it is possible to improve the accuracy of monitoring the progress of polishing and the accuracy of detecting an end point.

Generally, the light source has an effective energy in a limited wavelength band. As the wavelength of light is shorter, the light is scattered more largely by the slurry, the light transmission unit in the polishing pad, and the like, thus lowering an S/N ratio. The wavelength band to which the weight function is to be set is determined in consideration of the period of time variation of the characteristic value and the S/N ratio.

A process of simultaneously tracing two or more characteristic values derived from sets of a plurality of different weight functions will be described below.

Figure 11:
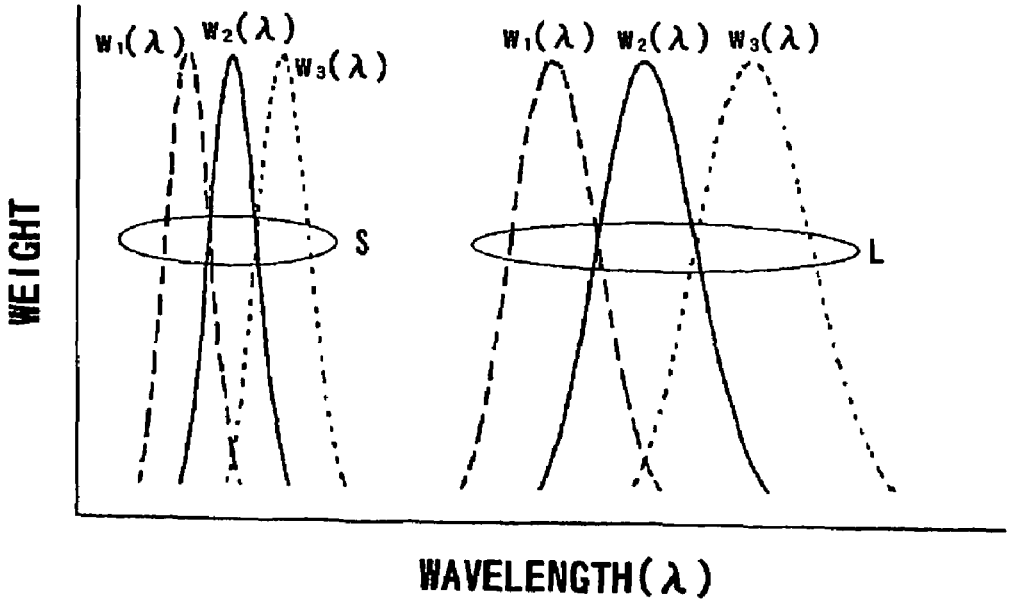
FIG. 11 is a graph illustrative of sets of weight functions at a short-wavelength and a long-wavelength, which are used in the polishing state monitoring apparatus according to the present invention.

As can be understood from FIG. 10, by simultaneously using characteristic values determined respectively from the sets L, S of weight functions shown in FIG. 11, it is possible to recognize the polishing process in 26 divided zones for further increasing the accuracy (resolution) of the monitoring process. Actually, since some extremal values of characteristic values with respect to both the sets L, S could occur substantially at the same time, the polishing process can be divided into less than 26 zones.

Figure 12:
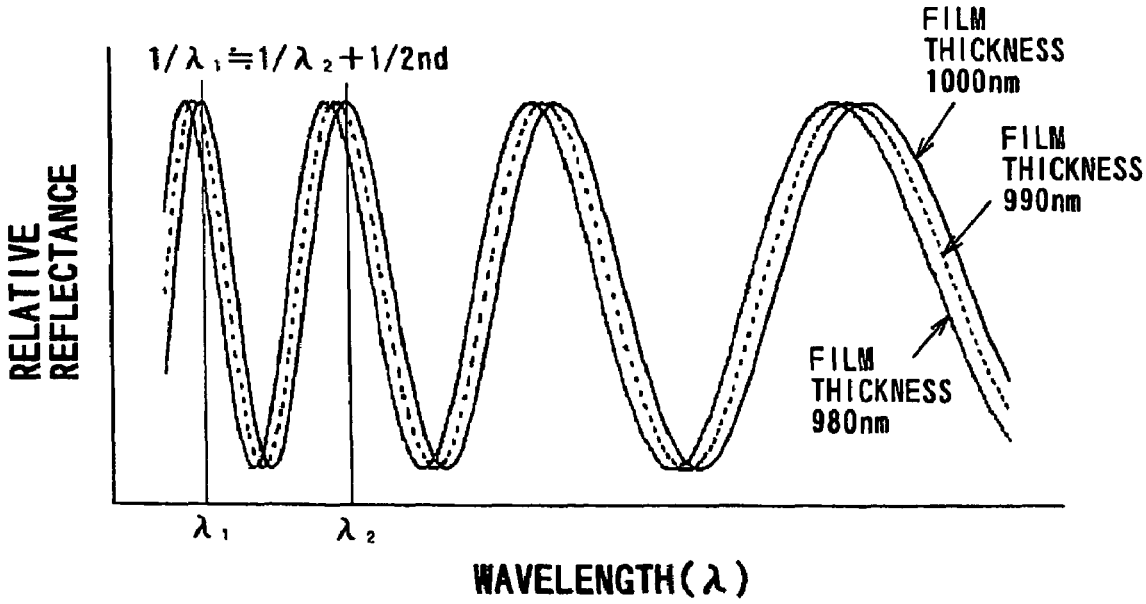
FIG. 12 is a graph illustrative of a time-varied relative reflectance while an oxide film is being polished, which are used in the polishing state monitoring apparatus according to the present invention, the graph showing a change in the spectral waveform due to a change in the film thickness.

An example in which the weight function is moved in a wavelength range and adjusted will be described below. If the film to be polished is a light-transmissive film such as an oxide film or the like, and has a uniform thickness and is in a disturbance-free ideal state, then the spectral waveform is as shown in FIG. 12 (corresponding to a graph plotted by changing the wave number into the wavelength on the horizontal axis shown in FIG. 5) because of an interference caused by the film being polished. If the film has a refractive index n and a film thickness d, and wavelengths with respect to adjacent maximum points (or minimum points) are represented by $\lambda_1$, $\lambda_2$, and it is assumed that the effect of a change in the phase of a light wave at the time of reflection is small, then the following equation is satisfied:

$$2nd/\lambda_1 \approx 2nd/\lambda_2+1, \text{ i.e., } 1/\lambda_1 \approx 1/\lambda_2+1/2nd$$

When the film thickness decreases as the polishing process progresses, maximum and minimum points on the spectral graph move from a long-wavelength toward a short-wavelength as indicated by the film thickness which changes from 1000 nm to 990 nm to 980 nm in FIG. 12. Therefore, it is expected that when the weight function moves to the long-wavelength side, extremal values of the characteristic values appear earlier.

Figure 13:
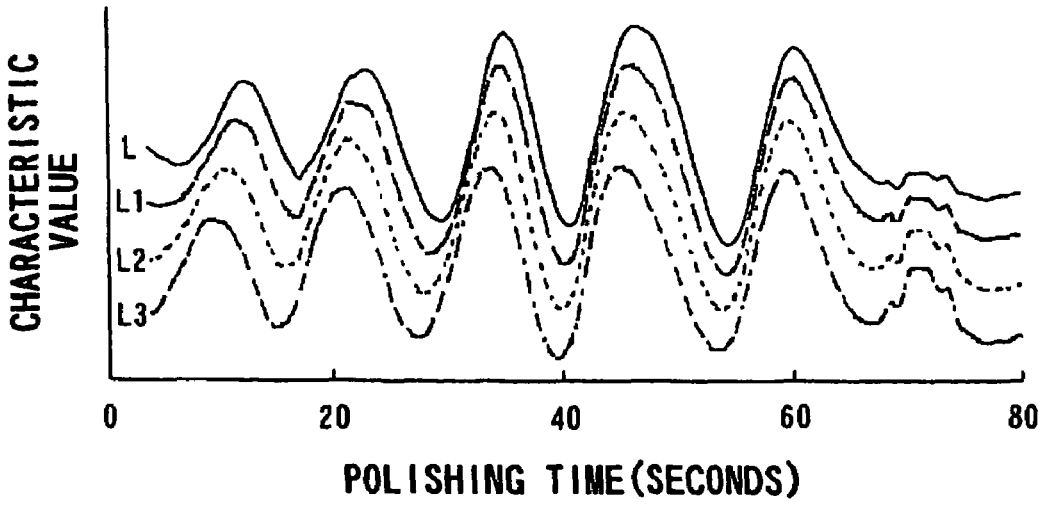
FIG. 13 is a graph illustrative of phase changes of characteristic values with respect to movement of the wavelength ranges of weight functions, which are used in the polishing state monitoring apparatus according to the present invention.

FIG. 13 shows an example in which the characteristic value $X_3$ is monitored according to the equation (11) using the set L of weight functions of FIG. 11 and weight functions L1, L2, L3 which are obtained by moving the weight functions of the set L on the wavelength axis toward the long-wavelength side by 10 nm, 20 nm, 30 nm, respectively, when the same pattern oxide film as shown in FIG. 10 is polished. It can be seen from FIG. 13 that the phase of time variation of characteristic values is shifted more forwardly as the weight functions are moved toward the long-wavelength.

Therefore, extremal values (peaks or bottoms) of time variation of characteristic values can be adjusted to desired timings by moving and adjusting the weight functions on the wavelength axis based on the waveform of time-varied characteristic values with respect to a sample wafer that has been polished in advance. Thus, the overpolishing time can be minimized to increase the accuracy of an end point detection.

Specifically, the overpolishing time is established based on peaks of characteristic values. Inasmuch as the polishing in the overpolishing time is performed on the assumption that the film is not actually observed, but the polishing is effected at a uniform film thickness rate, it is better for the overpolishing time to be shorter for thereby obtaining an accurate polishing end point. Consequently, it is preferable that peaks of characteristic values and a polishing end point be as close to each other as possible. The peaks can be brought to desired timings by moving the weights of the weight functions toward the long-wavelength (or the short-wavelength) according to the above process. For determining the above-described weight functions, it is preferable to polish a wafer which is an object to be polished, acquire spectral data therefrom, performing a simulation to calculate characteristic values while adjusting weight functions, and adopt weight functions whose time variation of characteristic values exhibit a desired tendency.

Use of a continuous light source as the light source 30 will be described herein. In considering time variation of characteristic values (colors) determined according to the above process, if a pulsed light source is used as the light source 30, then colors vary due to the difference of patterns corresponding to measuring points on the semiconductor wafer W, thus tending to vary time variation of characteristic values at a high frequency. In such a case, it is difficult to grasp a general tendency of time variation of characteristic values. If a smoothing process such as a moving averaging process is effected in order to suppress high-frequency fluctuations, then a phase delay occurs, and the detection of a polishing end point is delayed.

Figure 14:
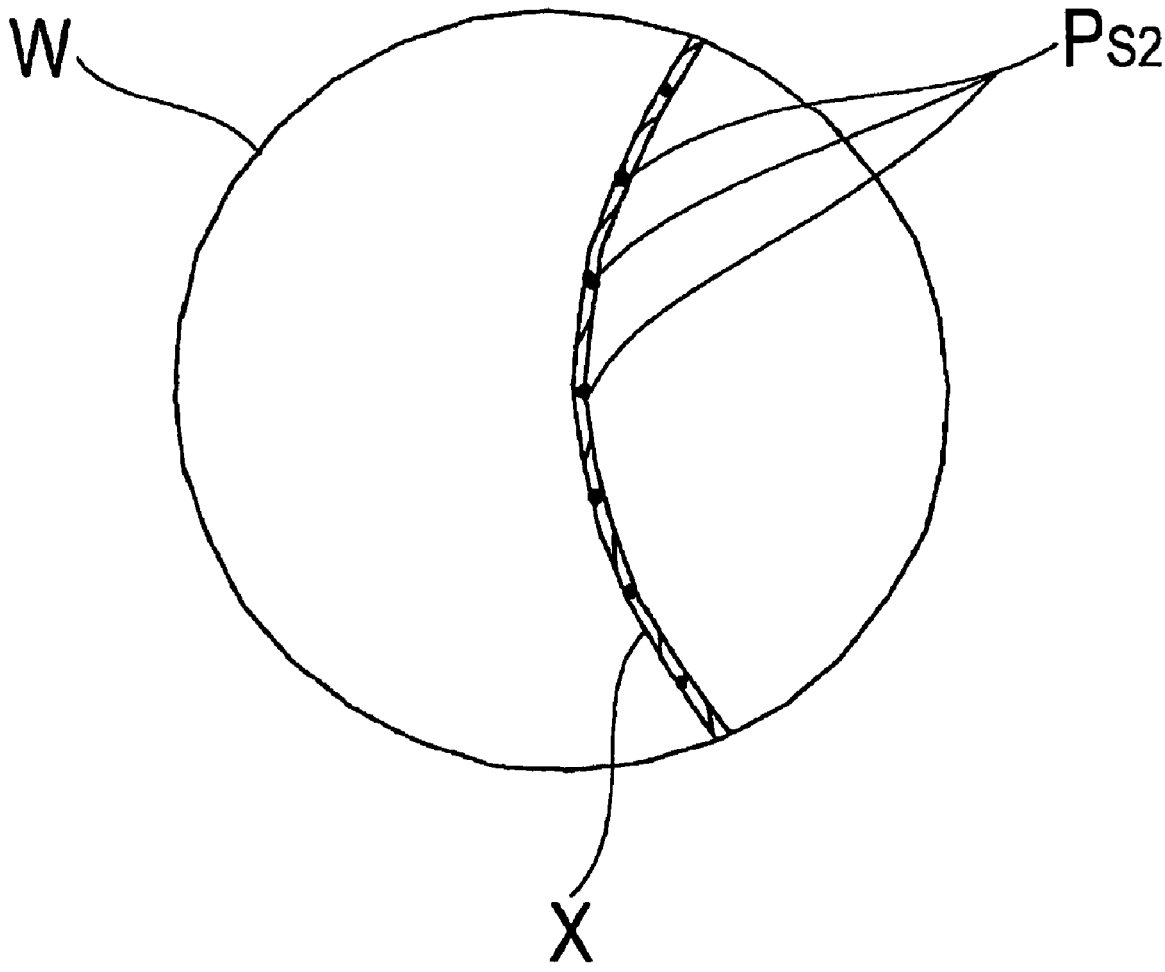
FIG. 14 is a plan view showing sampling points in a case where a continuous light source is used in the polishing state monitoring apparatus according to the present invention.

It is preferable to use a continuous light source as the light source 30 for suppressing such high-frequency fluctuations. FIG. 14 shows the relationship between sampling points $P_{S2}$ and a measuring area X corresponding to the sampling points $P_{S2}$ in the case where a continuous light source is used as the light source 30. As shown in FIG. 14, reflected light before and after each of the sampling points $P_{S2}$ is successively accumulated in each photodetector, and physically averaged. Therefore, fluctuations due to the effect of patterns are reduced, thus reducing the high-frequency fluctuations described above.

For measuring a remaining film on the surface, being polished, of the semiconductor wafer W, it is important to see a transition of the remaining film at particular points, such as the center of the semiconductor wafer W and the peripheral portion of the semiconductor wafer W. If the sampling period is fixed, however, the sampling points are fixed in position on a line along which the light transmission unit 22 scans the surface, being polished, of the semiconductor wafer W, depending on the rotational speed of the polishing table 12. For example, the peripheral portion of the semiconductor wafer W cannot be measured. According to the present embodiment, the sampling period, i.e., the accumulation times of the photodetectors can be adjusted based on the rotational speed of the polishing table 12.

Figure 15:
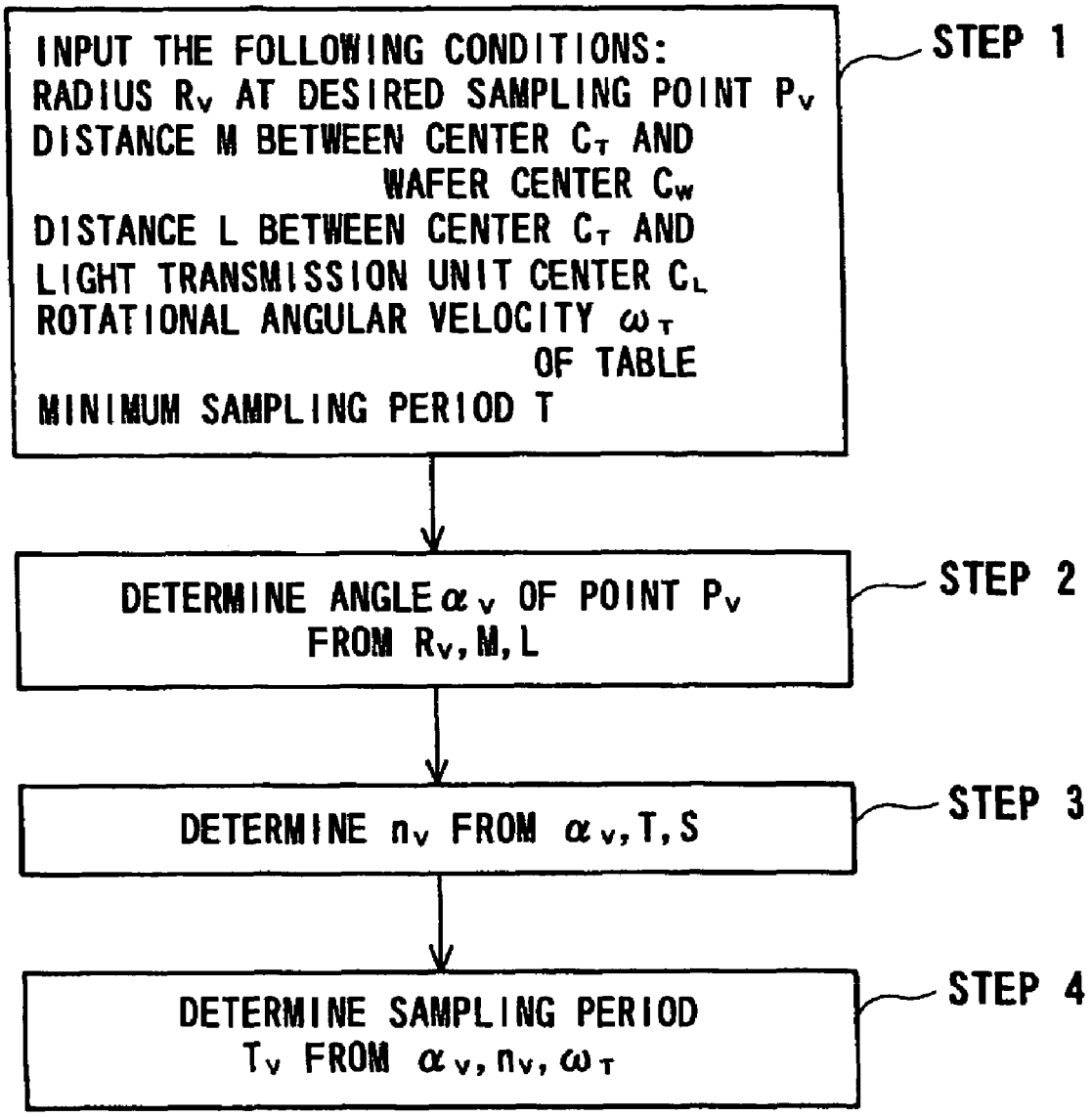
FIG. 15 is a flowchart of a process for adjusting a sampling period in the polishing state monitoring apparatus according to the present invention.
Figure 16:
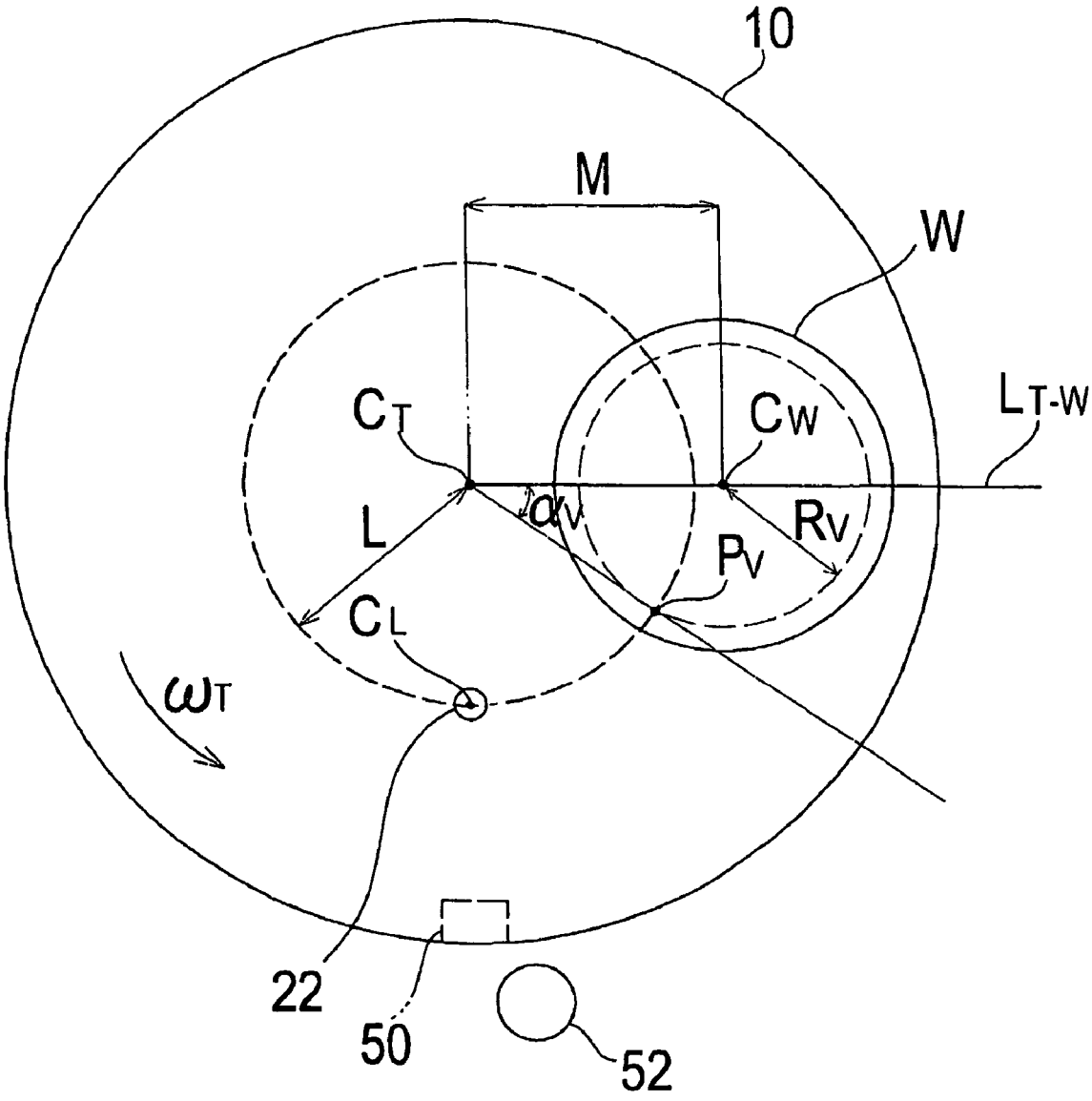
FIG. 16 is a plan view illustrative of the manner in which a sampling period is adjusted in the polishing state monitoring apparatus according to the present invention.

FIG. 15 is a flowchart of a process of adjusting the sampling period based on the rotational speed of the polishing table 12. First, as shown in FIG. 16, conditions including the radius $R_V$ at a desired point $P_V$ that should be used as a sampling point, the horizontal distance M between the center $C_T$ of the polishing table 12 and the center $C_W$ of the semiconductor wafer W, the horizontal distance L between the center $C_T$ of the polishing table 12 and the center $C_L$ of the light transmission unit 22, the rotational angular velocity $\omega_T$ of the polishing table 12, and the minimum sampling period T are inputted (step 1). These conditions may be inputted by the operator through a keyboard of a personal computer as the processor 48, or may be stored in a memory in advance, or may be transmitted from the controller of the polishing apparatus.

Then, an angle $\alpha_V$ from a wafer center line $L_{T\text{-}W}$ at the center $C_T$ of the polishing table 12 is determined according to the equation (1) (step 2). The number $n_V$ of sampling points from the point $P_V$ to the wafer center line $L_{T\text{-}W}$ is determined according to the inequality (2) (step 3). No matter whether the light source 30 comprises a pulsed light source or not, the inequality (2) related to a pulsed light source is used if the point $P_V$ is positioned sufficiently inside of the surface, being measured, of the semiconductor wafer W. Then, based on the angle $\alpha_V$ and the number $n_V$ of sampling points thus calculated, a sampling period $T_V$ is calculated according to the following equation (19) (step 4):

$$T_V = \frac{\alpha_V}{n_V \omega_T} \tag{19}$$

According to the sampling period $T_V$ thus determined, the point $P_V$ at the desired radius $R_V$ can be measured. Therefore, by adjusting the desired radius $R_V$ that is inputted as a condition, a desired radial position such as a peripheral portion of a wafer may be used as a sampling point in addition to points on the wafer center line $L_{T\text{-}W}$, as shown in FIG. 16.

Although certain preferred embodiments of the present invention have been shown and described in detail, it should be understood that various changes and modifications may be therein without departing from the scope of the appended claims.

INDUSTRIAL APPLICABILITY

The present invention is applicable to a polishing apparatus for polishing a workpiece such as a semiconductor wafer to a planar finish, and is preferably utilized in manufacturing semiconductor devices.

The invention claimed is:

1. A polishing apparatus comprising:

a top ring for holding a workpiece;

a rotating polishing table having a polishing surface which is brought in sliding contact with the workpiece;

a pulsed light source energizing at a sampling time;

a light transmission unit provided in said polishing surface, wherein said top ring is controlled such that said light transmission unit passes across a center of the workpiece;

a light-emitting unit for applying light from said pulsed light source to a surface, being polished, of the workpiece;

a light-receiving unit for receiving reflected light reflected from the surface of the workpiece and transmitted through said light transmission unit;

a spectroscope unit for dividing the reflected light received by said light-receiving unit into a plurality of light rays having respective wavelengths;

light-receiving elements for detecting the light rays divided by said spectroscope unit, wherein each of said light-receiving elements accumulates the detected light rays as electrical information during a sampling period and releases the electrical information; and a control unit for controlling said pulsed light source to energize when said pulsed light source faces the center of the workpiece.

2. A polishing apparatus according to claim 1, further comprising:

a position sensor mounted on the outer circumferential edge of said polishing table for detecting a rotation angle of said polishing table by detecting a dog which represents a reference position.

3. A polishing apparatus according to claim 2, wherein an interval of the sampling time and a next sampling time of said pulsed light source corresponds to the sampling period of said light-receiving elements.

4. A polishing apparatus according to claim 3, wherein said control unit controls said pulsed light source to start energizing said pulsed light source as a sampling start time, based on the following equation, $$t_s = \frac{\theta}{\omega_T} - \left(nT + \frac{T+S}{2}\right)$$

wherein:

$t_S$ represents a sampling start time;

θ represents a rotation angle when said position sensor detects the reference position;

$\omega_T$ represents an angular velocity of said polishing table;

n represents a number of sampling points from a workpiece center line, which interconnects the center of said polishing table and the center of the workpiece, to a workpiece edge except for a sampling point on the workpiece center line;

T represents the sampling period of said light-receiving elements; and

S represents a time after the releasing of the electrical information of a first one of said light-receiving elements until the releasing of the electrical information of a last one of said light-receiving elements.

5. A polishing apparatus comprising:

a top ring for holding a workpiece;

a rotating polishing table having a polishing surface which is brought in sliding contact with the workpiece;

a continuous light source;

a light transmission unit provided in said polishing surface, wherein said top ring is controlled such that said light transmission unit passes across a center of the workpiece;

a light-emitting unit for applying light from said continuous light source to a surface, being polished, of the workpiece;

a light-receiving unit for receiving reflected light reflected from the surface of the workpiece and transmitted through said light transmission unit;

a spectroscope unit for dividing the reflected light received by said light-receiving unit into a plurality of light rays having respective wavelengths;

light-receiving elements for detecting the light rays divided by said spectroscope unit, wherein each of said light-receiving elements accumulates the detected light rays as electrical information during a sampling period and releases the electrical information; and a control unit for controlling said light-receiving elements so that said light transmission unit faces the center of the workpiece at a sampling time of said light-receiving elements, wherein the sampling time represents a half of a time after a first one of said light-receiving elements starts storing electrical information until a last one of said light-receiving elements releases electrical information.

6. A polishing apparatus according to claim 5, further comprising:

a position sensor mounted on the outer circumferential edge of said polishing table for detecting a rotation angle of said polishing table by detecting a dog which represents a reference position.

7. A polishing apparatus according to claim 5, wherein said control unit calculates a number of sampling points based on the following equation, $$\alpha - \omega_T T \leqq n\omega_T T + \omega_T \frac{T+S}{2} < \alpha$$

wherein:

α represents a half of an angle at which said light transmission unit scans the surface of the workpiece;

$\omega_T$ represents an angular velocity of said polishing table;

n represents a number of sampling points from a workpiece center line, which interconnects the center of said polishing table and the center of the workpiece, to a workpiece edge except for a sampling point on the workpiece center line;

T represents the sampling period of said light-receiving elements; and

S represents a time after the releasing of the electrical information of said first light-receiving element until the releasing of the electrical information of said last light-receiving element.

8. A polishing apparatus according to claim 5, wherein said control unit is capable of adjusting the sampling period of a sampling process performed by said light-receiving elements based on a rotational speed of said polishing table.

9. A polishing apparatus according to claim 5, wherein said light source emits light having a wavelength band.

10. A method of polishing a workpiece, the method comprising:

holding a workpiece by a top ring;

rotating a polishing table having a polishing surface so as to be in sliding contact with the workpiece;

energizing a pulsed light source at a sampling time;

controlling said top ring such that a light transmission unit provided in said polishing surface passes across a center of the workpiece;

applying light from said pulsed light source to a surface, being polished, of the workpiece by a light-emitting unit;

receiving reflected light reflected from the surface of the workpiece and transmitted through said light transmission unit by a light-receiving unit;

dividing the reflected light received by said light-receiving unit into a plurality of light rays having respective wavelengths by a spectroscope unit;

detecting the light rays divided by said spectroscope unit by light-receiving elements, wherein each of said light-receiving elements accumulates the detected light rays as electrical information during a sampling period and releases the electrical information; and controlling said pulsed light source by a control unit to energize when said pulsed light source faces the center of the workpiece.

11. A method according to claim 10, further comprising:

detecting a rotation angle of said polishing table by detecting a dog which represents a reference position using a position sensor mounted on the outer circumferential edge of said polishing table.

12. A method according to claim 11, wherein an interval of the sampling time and a next sampling time of said pulsed light source corresponds to the sampling period of said light-receiving elements.

13. A method according to claim 12, wherein said control unit controls said pulsed light sourced to start energizing said pulsed light source as a sampling start time, based on the following equation, $$t_s = \frac{\theta}{\omega_T} - \left(nT + \frac{T+S}{2}\right)$$

wherein:

$t_S$ represents a sampling start time;

θ represents a rotation angle when said position sensor detects the reference position;

$\omega_T$ represents an angular velocity of said polishing table;

n represents a number of sampling points from a workpiece center line, which interconnects the center of said polishing table and the center of the workpiece, to a workpiece edge except for a sampling point on the workpiece center line;

T represents the sampling period of said light-receiving elements; and

S represents a time after the releasing of the electrical information of a first one of said light-receiving elements until the releasing of the electrical information of a last one of said light-receiving elements.

14. A method of polishing a workpiece, the method comprising:

holding a workpiece by a top ring;

rotating a polishing table having a polishing surface so as to be in sliding contact with the workpiece;

controlling said top ring such that a light transmission unit provided in said polishing surface passes across a center of the work piece;

applying light from a continuous light source to a surface, being polished, of the workpiece by a light-emitting unit;

receiving reflected light reflected from the surface of the workpiece and transmitted through said light transmission unit by a light-receiving unit;

dividing the reflected light received by said light-receiving unit into a plurality of light rays having respective wavelengths by a spectroscope unit;

detecting the light rays divided by said spectroscope unit by light-receiving elements, wherein each of said light-receiving elements accumulates the detected light rays as electrical information during a sampling period and releases the electrical information; and controlling said light-receiving elements by a control unit so that said light transmission unit faces the center of the workpiece at a sampling time of said light-receiving elements, wherein the sampling time represents a half of a time after a first one of said light-receiving elements starts storing electrical information until a last one of said light-receiving elements releases electrical information.

15. A method according to claim 14, further comprising:

detecting a rotation angle of said polishing table by detecting a dog which represents a reference position using a position sensor mounted on the outer circumferential edge of said polishing table.

16. A method according to claim 14, wherein said control unit calculates a number of sampling points based on the following equation, $$\alpha - \omega_T T \leqq n\omega_T T + \omega_T \frac{T+S}{2} < \alpha$$

wherein:

α represents a half of an angle at which said light transmission unit scans the surface of the workpiece;

$\omega_T$ represents an angular velocity of said polishing table;

n represents a number of sampling points from a workpiece center line, which interconnects the center of said polishing table and the center of the workpiece, to a workpiece edge except for a sampling point on the workpiece center line;

T represents the sampling period of said light-receiving elements; and

S represents a time after the releasing of the electrical information of said first light- receiving element until the releasing of the electrical information of said last light-receiving element.

17. A method according to claim 14, wherein said control unit is capable of adjusting the sampling period of a sampling process performed by said light-receiving elements based on a rotational speed of said polishing table.

18. A method according to claim 14, wherein said light source emits light having a wavelength band.

* * * * *